US010793802B2

(12) United States Patent
Abraham et al.

(10) Patent No.: US 10,793,802 B2
(45) **Date of Patent: *Oct. 6, 2020**

(54) MIXED PHOSPHORUS ESTERS FOR LUBRICANT APPLICATIONS

(71) Applicant: The Lubrizol Corporation, Wickliffe, OH (US)

(72) Inventors: William D. Abraham, Concord Township, OH (US); Nga H. Nguyen, Scotch Plains, NJ (US); Paul E. Adams, Willoughby, OH (US); Kurt F. Wollenberg, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 361 days.

This patent is subject to a terminal disclaimer.

(21) Appl. No.: 15/525,691

(22) PCT Filed: Nov. 11, 2015

(86) PCT No.: PCT/US2015/060106

§ 371 (c)(1),
(2) Date: May 10, 2017

(87) PCT Pub. No.: WO2016/089565

PCT Pub. Date: Jun. 9, 2016

(65) Prior Publication Data

US 2017/0335224 A1 Nov. 23, 2017

Related U.S. Application Data

(60) Provisional application No. 62/078,607, filed on Nov. 12, 2014.

(51) Int. Cl.

| | |
|---|---|
| ***C10M 163/00*** | (2006.01) |
| ***C10M 137/02*** | (2006.01) |
| ***C10M 137/04*** | (2006.01) |
| ***C10M 153/04*** | (2006.01) |
| ***C10M 169/04*** | (2006.01) |
| *C10N 10/04* | (2006.01) |
| *C10N 30/06* | (2006.01) |
| *C10N 30/00* | (2006.01) |
| *C10N 40/04* | (2006.01) |
| *C10N 40/25* | (2006.01) |
| *C10N 40/00* | (2006.01) |
| *C10N 60/10* | (2006.01) |
| *C10N 60/14* | (2006.01) |
| *C10N 70/00* | (2006.01) |

(52) U.S. Cl.

CPC ..... *C10M 137/02* (2013.01); *C10M 137/04* (2013.01); *C10M 153/04* (2013.01); *C10M 169/04* (2013.01); *C10M 2203/1006* (2013.01); *C10M 2203/1025* (2013.01); *C10M 2207/026* (2013.01); *C10M 2207/28* (2013.01); *C10M 2207/282* (2013.01); *C10M 2207/289* (2013.01); *C10M 2209/084* (2013.01); *C10M 2215/04* (2013.01); *C10M 2215/042* (2013.01); *C10M 2215/064* (2013.01); *C10M 2215/08* (2013.01); *C10M 2215/223* (2013.01); *C10M 2215/224* (2013.01); *C10M 2215/26* (2013.01); *C10M 2215/28* (2013.01); *C10M 2215/30* (2013.01); *C10M 2219/046* (2013.01); *C10M 2219/106* (2013.01); *C10M 2223/049* (2013.01); *C10M 2225/00* (2013.01); *C10M 2227/00* (2013.01); *C10M 2227/061* (2013.01); *C10N 2010/04* (2013.01); *C10N 2030/06* (2013.01); *C10N 2030/42* (2020.05); *C10N 2030/45* (2020.05); *C10N 2040/04* (2013.01); *C10N 2040/042* (2020.05); *C10N 2040/045* (2020.05); *C10N 2040/25* (2013.01); *C10N 2040/42* (2020.05); *C10N 2060/10* (2013.01); *C10N 2060/14* (2013.01); *C10N 2070/00* (2013.01)

(58) Field of Classification Search

CPC ..... C10M 133/02; C10M 137/04; C10M 137/02; C10M 153/04

USPC ..... 508/186

See application file for complete search history.

(56) References Cited

U.S. PATENT DOCUMENTS

| | | | | |
|---|---|---|---|---|
| 3,228,998 | A | 1/1966 | Fierce et al. | |
| 3,328,360 | A | 6/1967 | Rozanski et al. | |
| 4,298,481 | A | 11/1981 | Clarke | |
| 4,549,976 | A | 10/1985 | Horodysky et al. | |
| 4,557,845 | A | 12/1985 | Horodysky et al. | |
| 4,704,218 | A | 11/1987 | Horodysky et al. | |
| 5,544,744 | A | 8/1996 | Oman | |
| 5,773,392 | A | 6/1998 | Romanelli et al. | |
| 6,103,673 | A | 8/2000 | Sumiejski et al. | |
| 6,730,640 | B2 | 5/2004 | Sowerby et al. | |
| 8,450,255 | B2 | 5/2013 | Ikeda et al. | |
| 8,691,740 | B2 * | 4/2014 | Vickerman | C10M 133/16 508/500 |
| 2004/0192562 | A1 * | 9/2004 | Morita | C10M 163/00 508/185 |
| 2013/0079264 | A1 * | 3/2013 | Tipton | C10M 153/00 508/426 |

FOREIGN PATENT DOCUMENTS

| | | | |
|---|---|---|---|
| GB | 1146379 | A1 | 3/1969 |
| WO | 2010/126760 | A2 | 11/2010 |

* cited by examiner

*Primary Examiner* — Prem C Singh
*Assistant Examiner* — Francis C Campanell
(74) *Attorney, Agent, or Firm* — Michael Miller; David Shold; Teres

(57) ABSTRACT

A lubricant composition of an oil of lubricating viscosity and a phosphite ester reaction product of a monomeric phosphorous acid or an ester thereof with a first alkylene diol having two hydroxy groups in a 1,4 or 1,5 or 1,6 relationship and a second, alkyl-substituted, diol being a substituted 1,3-propylene diol, exhibits good wear and frictional performance.

35 Claims, No Drawings

MIXED PHOSPHORUS ESTERS FOR LUBRICANT APPLICATIONS

CROSS REFERENCE TO RELATED APPLICATION

This application claims priority from PCT Application Serial No. PCT/US2015/060106 filed on Nov. 11, 2015, which claims the benefit of U.S. Provisional Application No. 62/078,607 filed on Nov. 12, 2014, both of which are incorporated in their entirety by reference herein.

BACKGROUND OF THE INVENTION

The disclosed technology relates to phosphites which may be oligomeric or polymeric materials, and their use in lubricant formulations, including lubricants for driveline and other applications.

Phosphorus esters of various types are well known for their use as lubricant additives. For example, U.S. Publication 2013/0079264, Tipton et al., Mar. 28, 2013, discloses a polymeric phosphorus ester comprising the condensation product of a monomeric phosphorus acid or an ester thereof with a diol, wherein the two hydroxy groups of the diol are separated by a chain of 4 to about 100 carbon atoms. An appropriately small amount of diol material having 2 or 3 atoms separating the hydroxy groups may be employed, provided that it does not substantially interfere with the polymer formation. Examples are compared from 1,6-hexanediol, 1,4-butanediol, diethylene glycol, or triethylene glycol. The polymeric phosphorus ester contains at least three phosphorus-containing monomer units.

U.S. Pat. No. 6,730,640, Sowerby et al., May 4, 2004, discloses a method for lubricating a continuously variable transmission. The lubricant is a fluid composition which comprises an oil of lubricating viscosity and an oil-soluble zinc salt, which may be a zinc hydrocarbyl phosphate. The zinc hydrocarbyl phosphate can be prepared by reacting phosphorus acid or anhydride with an alcohol, followed by neutralization with a zinc base. The alcohols may be monohydric alcohols, or polyhydric alcohols such as alkylene polyols such as ethylene glycols, including di-, tri- and tetraethylene glycols; propylene glycols, including di-, tri- and tetrapropylene glycols; glycerol; and the like. Additional additives may also be present, such as other friction modifiers and phosphorus-containing antioxidants.

U.S. Pat. No. 4,557,845, Horodysky et al., Dec. 10, 1985, discloses products of reaction between a 2-hydroxyalkylalkylamine or certain higher oxylated members, and a dihydrocarbyl phosphite as friction reducers and fuel reducing additives for internal combustion engines when such products are compounded with lubricant and liquid fuels. Among the reaction products are compounds such as

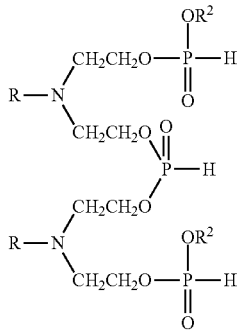

where R is a $C_6$ to $C_{30}$ hydrocarbyl group.

U.S. Pat. No. 5,773,392, Romanelli et al, Jun. 30, 1998, discloses an oil-soluble complex of an oil-insoluble phosphorus-containing acid and an alcohol. In certain examples, phosphorous acid is reacted with octylthioethanol and thiobisethanol. The complex is a useful antiwear additive.

U.S. Pat. No. 3,228,998, Fierce et al., Jan. 11, 1966, discloses liquid polyphosphate esters which may be useful as functional fluids. The general formula of the esters is

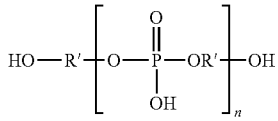

U.S. Pat. No. 3,328,360, Rozanski et al., Jun. 27, 1967, discloses polymers containing phosphorus, by reacting a mixture of direactive material and $P_4S_{10}$. Suitable direactive materials include, e.g., 1,10-decanediol. Derivatives of the phosphomers are generally useful as lubricant additives.

U.S. Pat. No. 5,544,744, Bloch et al., Aug. 22, 1995, discloses antiwear and antioxidant additives for use in lubricating oils. The additive is the reaction product of a phosphating agent and a thioalcohol. The alcohols may be represented by A-OH or OH—B—OH.

U.S. Pat. No. 4,549,976, Horodysky et al., Oct. 29, 1985, discloses lubricants and liquid fuel compositions containing a phosphorus oxyhalide vicinal diol reaction product. Examples show a phosphate ester of 1,2-mixed pentadecanediol-octadecanediol.

GB 1 146 379, Melle-Bezons, Mar. 26, 1969, discloses a transmission fluid using isopropylidene-bis[4-(nonylphenyl-decyl-phosphite)-cyclohexyl] as the antioxidant.

U.S. Pat. No. 4,298,481, Clarke, Nov. 3, 1981, discloses high temperature grease composition which contains a load bearing component. Useful load-bearing additives include polyphosphates including those of the structure $$(R_1O)(R_2O)P—OR_3O\text{-}[O—P(OR_4)—OR_5O]_n—P(OR_6)(OR_7) \quad \text{[sic]}$$

$R_3$ and $R_5$ are polyalkylene glycol, alkylidene bisphenol, hydrogenated alkylidene bisphenol, or ring-halogenated alkylidene bisphenol from which the two terminal hydrogens have been removed; n is an integer in the range of 1 to 18.

U.S. Pat. No. 4,704,218, Horodysky et al., Nov. 3, 1987, discloses the reaction products of long chain vicinal diols containing at least 10 carbon atoms and one or more sulfur atoms in the chain, with a dihydrocarbyl hydrogen phosphate containing 1 to 6 carbon atoms in each hydrocarbyl group, as effective friction-reducing antiwear additives in lubricating oils, greases and fuels.

U.S. Pat. No. 6,103,673, Sumiejski et al., Aug. 15, 2000, discloses compositions containing friction modifiers for continuously variable transmissions, which include at least 0.1 percent by weight of at least one phosphorus compound. The phosphorus compound can be a phosphorus acid or ester of the formula $(R^1X)(R^2X)P(X)_nX_mR^3$ where $R^1$, $R^2$, and $R^3$ are hydrogen or hydrocarbyl groups. $R^1$ and $R^2$ groups can comprise a mixture of hydrocarbyl groups derived from commercial alcohols, examples being monohydric alcohols.

Driveline transmissions, especially automatic transmission fluids (ATFs), present highly challenging technological problems and solutions for satisfying the multiple and often conflicting lubricating and power transmitting requirements of modern automatic transmissions (including continuously variable transmissions of various types). Many additive components are typically included in an ATF, providing such performance characteristics as lubrication, dispersancy, friction control (for clutches), anti-wear durability (e.g., gear wear) and pump durability, fuel economy, anti-shudder performance, anti-corrosion and anti-oxidation performance.

Low molecular weight phosphites such as dialkyl (e.g., dibutyl) phosphites (sometime referred to as dialkyl hydrogen phosphites), notwithstanding their known performance benefits when used in driveline lubricants, may exhibit certain problems. For instance, they may absorb into elastomeric seals, leading to degradation of the seal material. They may also interact with sulfur-containing materials within a lubricant to give rise to objectionable odor.

SUMMARY OF THE INVENTION

The disclosed technology provides a lubricant composition comprising an oil of lubricating viscosity and a phosphite ester composition (e.g., other than a zinc salt), which comprises (A) the reaction product of (a) a monomeric phosphorous acid or an ester thereof with (b) at least two alkylene diols: a first alkylene diol (i) having two hydroxy groups in a 1,4 or 1,5 or 1,6 relationship; and a second alkylene diol (ii) being an alkyl-substituted 1,3-propylene diol with one or more of the alkyl substituents thereof being on one or more of the carbon atoms of the propylene unit, the total number of carbon atoms in the alkyl-substituted 1,3-propylene diol being 5 or 6 to 12; the relative molar amounts of monomeric phosphorous acid or ester thereof (a) and the total of the alkylene diols (b) being in a ratio of 0.9:1.1 to 1.1:0.9; and the relative molar amounts of the first alkylene diol (i) and the alkyl-substituted 1,3-propylene diol (ii) being in a ratio of 30:70 to 65:35.

The above-described lubricant composition may be in some embodiments be characterized in that the oil of lubricating viscosity has a kinematic viscosity at 100° C. of 2.8 to 3.6 $mm^2/s$ (cSt), or 2.8 to 5, or in some embodiments 3.6 to 6.5 or 3.8 to 4.5 $mm^2/s$, and a viscosity index of 104 to 150 or 104 to 130 or 110 to less than 120; and wherein the lubricant composition further comprises: (B) 1.2 to 5.0 wt % of at least one borated dispersant, wherein at least one borated dispersant is further functionalized with a sulfur or phosphorus moiety; (C) a calcium-containing detergent, wherein the detergent is present in an amount to deliver at least 110 ppm to 700 ppm (or 130-600, or 160-400 ppm) of calcium to the lubricant composition; (D) at least one phosphorus-containing compound in addition to the phosphite ester composition (A); and (E) 0.1 wt % to 5 wt % of a viscosity modifier (optionally linear polymeric viscosity modifier) having dispersant functionality, wherein the viscosity modifier has a weight average molecular weight of 5,000 to 25,000. Such an embodiment may be particularly useful for lubricating an automatic transmission.

In other embodiments the oil of lubricating viscosity may be as characterized above, and the lubricant composition may further comprise one or more (or all) of: (B') 1.2 to 5 weight percent of one or more succinimide dispersants, at least one of which is a borated dispersant, and which may further be treated/reacted with one or more of terephthalic acid or dimercaptothiadiazole; (C') 0.05 to 1 weight percent of one or more calcium-containing detergents, where the detergents may comprise sulfonate or salicylate detergent(s); (D') 0.05 to 0.25 weight percent of an inorganic phosphorus acid (e.g., 85% phosphoric acid); (E') 0.1 to 7 or 0.4 to 5 weight percent of a nitrogen-containing dispersant viscosity modifier such as a polymethacrylate dispersant viscosity modifier; and (F') 1 to 4 weight percent of a friction modifier as described herein. Other materials may include one or more of antioxidants, corrosion inhibitors, seal swell agents, pour point depressants, and foam inhibitors. Such embodiments may likewise be particularly useful for lubricating an automatic transmission and are described in greater detail in U.S. Pat. No. 8,450,255, Sumiejski et al., May 28, 2013.

The above-described lubricant compositions may in other embodiments be characterized in further comprising (G) 0.2 to 3 percent by weight of an amide represented by the structure $R^3$—C(=O)—$NR^1R^2$ wherein $R^1$ and $R^2$ are each independently hydrocarbyl groups of at least 6 carbon atoms, such as 6 to 24 carbon atoms, and $R^3$ is a hydroxyalkyl group of 1 to 6 carbon atoms; (H) 0.03 to 0.5 percent by weight of a tertiary amine represented by the structure $R^4R^5NR^6$ where $R^4$ and $R^5$ are each independently hydrocarbyl groups of at least 6 carbon atoms, such as 6 to 24 carbon atoms, and $R^6$ is an alkyl group substituted by at least two hydroxy groups; (I) 2 to 5 percent by weight of a nitrogen-containing dispersant reacted with (i) dimercaptothiadiazole, (ii) a borating agent, and (iii) an inorganic phosphorus compound, and optionally (iv) an aromatic diacid having acid groups in 1,3 or 1,4 positions on a benzene ring; (J) 0.2 to 2 weight percent of a dialkyl phosphite wherein the two alkyl groups independently contain 3 to 6 carbon atoms, such as dibutyl phosphite; and (K) 0.1 to 1 weight percent of a trialkyl borate, wherein each alkyl group independently contains 4 to 12 carbon atoms. Such an embodiment may be particularly useful for lubricating a continuously variable transmission.

The above-described lubricant compositions may in other embodiments be characterized in further comprising (N) 0.1 to 4 percent by weight of a metal-containing overbased detergent having a TBN of at least 200, such as 250-1000 (calculated on an oil-free basis), wherein the metal-containing overbased detergent contributes 0.03 to 1.0% by weight of calcium to the lubricant composition; (O) 0.05 to 3 percent by weight of a dihydrocarbyl phosphite or a trihydrocarbyl phosphite wherein the hydrocarbyl groups (or alkyl groups) each independently contain 2 to 8 carbon atoms; (P) a phosphorus-containing material comprising a zinc dialkyldithiophosphate or $C_8$ to $C_{20}$ alkylamine salt of a mono- or di-alkyl phosphate or thiophosphate ester, in an amount to provide 100 to 2000 parts per million by weight of phosphorus to the lubricant composition; (Q) 0.1 to 0.3 percent by weight of 2,5-dimercapto-1,3,4-thiadiazole or a hydrocarbyl-substituted 2,5-dimercapto-1,3,4-thiadiazole; and (R) 0.1 to 5 percent by weight of a nitrogen-containing dispersant. Such an embodiment may be particularly useful for lubricating a manual transmission.

The above-described lubricant compositions may in other embodiments be characterized in further comprising (W) 1 to 3 percent, or 1.5 to 2.75 percent by weight of a alkylsuccinimide dispersant, where the alkyl group may typically be a polyisobutene group; (X) 0.2 to 0.7 percent, or 0.3 to 0.6 percent, or 0.3 to 0.5 percent by weight of a corrosion inhibitor such as a substituted thiadiazole; (Y) 0.25 to 0.65 percent, or 0.3 to 0.6 percent, or 0.35 to 0.5 percent by weight of one or more friction modifiers; and (Z) 0.05 to 0.4 percent, or 0.05 to 0.3 percent, or 0.1 to 0.3 percent by weight of a detergent. Such an embodiment may be particularly useful in lubricating a dual-clutch transmission.

The above-described lubricant compositions may in other embodiments be characterized in further comprising (a) one or more phosphorus-based antiwear agents such as a zinc dialkyldithiophosphate, or phosphite or phosphate esters amine salts, in an amount of 0.02 to 2 percent by weight or 0.5 to 1.5 or 0.8 to 1.2 or 0.9 to 1.1 percent by weight; (b) a borated dispersant in an amount of 0.1 to 1 percent or 0.2 to 0.5 or 0.3 to 0.4 percent by weight; (c) a dispersant (other than a borated dispersant, such as a succinimide dispersant) in an amount of 0.5 to 5 percent, or 1 to 3 or 1.8 to 2.5 percent by weight; (d) a borate ester friction modifier in an amount of 0.03 to 0.3, or 0.05 to 0.15, or 0.08 to 0.12 percent by weight; (e) an overbased metal detergent in an amount of 0.1 to 1.0 percent, or 0.2 to 0.6, or 0.3 to 0.5 percent by weight (the detergent may optionally have a TBN of 300 to 800 or 500 to 750 or 650 to 700); (f) one or more corrosion inhibitors in an amount of 0.03 to 0.3 percent or 0.05 to 0.2 or 0.08 to 0.12 percent by weight, and (g) additional materials such as pour point depressant, antioxidant, anti-foam agent, ester, and friction stabilizer, in a total amount of 0.5 to 3 percent or 1 to 2 percent by weight. Such an embodiment may be particularly useful in lubricating one or more of the transmissions, final drives, wet brakes, transmission clutches, hydraulic systems, or engines of off-highway vehicles such as farm tractors, construction equipment, or mining equipment.

The above-described lubricant composition may, in other embodiments, be characterized in further comprising (a) at least one ashless dispersant in an amount 0.5 to 6 weight percent; (b) at least one metal containing overbased detergent in an amount 0.5 to 3 weight percent of the composition (which may in some embodiments deliver 110 to 2500 ppm calcium to the composition); (c) at least one additional zinc-free anti-wear agent which may be a phosphorus-containing compound different from that of the invention, a sulfur- and phosphorus-free organic anti-wear agent, or mixtures thereof, in an amount 0.01 to 2 weight percent of the composition; (d) at least one ashless antioxidant (which may be a hindered phenol and/or a diarylamine) in an amount 0.2 to 5 weight percent of the composition; and (e) a polymeric viscosity index improver in an amount 0.0 to 6 weight percent of the composition. In addition, the lubricating composition may contain one or more additional additives such as corrosion inhibitors, foam inhibitors, seal swell agents, and pour point depressants. In such embodiments, the amount of the presently disclosed phosphite compound may be, for example, 0.01 to 2.0 weight percent. The oil of lubricating viscosity, in such embodiments, may be, for example, a Group I, Group II, Group III mineral oil or combinations thereof, with a kinematic viscosity of 3.6 to 7.5 $mm^2/s$, or 3.8 to 5.6 $mm^2/s$, or 4.0 to 4.8 $mm^2/s$. Such embodiments may be particularly useful for lubricating an internal combustion engine, e.g., as a crankcase lubricant.

The disclosed technology further provides a method for lubricating mechanical device, comprising thereto the above-described lubricant composition.

The disclosed technology thus provides relatively higher molecular weight, oligomeric or polymeric phosphites which provide phosphorus and consequent antiwear performance properties to lubricant formulations, while providing a lubricant having at least one of the properties of reduced degradation of elastomeric seals, reduced odor, reduced toxicity, reduced volatility, and reduced corrosion.

DETAILED DESCRIPTION OF THE INVENTION

Various preferred features and embodiments will be described below by way of non-limiting illustration.

As used herein, the viscosity index is determined by employing ASTM method D2270-10e1. The kinematic viscosity at 100° C. is measured by the methodology of ASTM D445-12. The Brookfield viscosity is measured by ASTM D2983-09 at −40° C. (Brookfield viscosity at −40° C.). As used herein the expression "(meth)acrylic," (meth)acrylate," and related terms is intended to encompass both acrylic functionality as well as methacrylic functionality. Typically the "(meth)acrylic," (meth)acrylate," and related terms is intended to include a methacrylic or methacrylate. The term "ppm" means parts per million by weight.

The lubricant compositions as disclosed herein include, as one component, an oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition.

The oil of lubricating viscosity of the invention may have a kinematic viscosity at 100° C. of 2.8 to 3.6 cSt ($mm^2/s$), or 2.9 to 3.5 cSt ($mm^2/s$), or 3.0 to 3.4 cSt ($mm^2/s$), or in certain embodiments 3.6 to 6.5 or 2.8 to 4.5 $mm^2/s$. This oil of lubricating viscosity may also be defined as an API Group II+ base oil. API Group II+ base oils are known and described for example in SAE publication entitled "Design Practice: Passenger Car Automatic Transmissions," fourth Edition, AE-29, published 2012, page 12-9. U.S. Pat. No. 8,216,448 also defines an API Group II+ as a "Group II plus base oil" having a viscosity index greater than or equal to 110 and less than 120.

The oil of lubricating viscosity of the invention may have a viscosity index (VI) of 104 to 150, or 104 to 145, or 104 to 140, or 104 to 135, or 104 to 130, or at least 105, or at least 110, or at least 115 to 130. The viscosity index may be in the range of 104 to 125, or 110 to less than 120. In one embodiment the oil of lubricating viscosity has a kinematic viscosity at 100° C. of 2.8 to 3.6 cSt ($mm^2/s$) and a viscosity index of 110 to less than 120;

Examples of an oil of lubricating viscosity of the disclosed technology include base oils sold under the registered trade names of S-Oil, Nexbase, Yubase, Petrocanada, and Chevron neutral oil 110RLV.

The oil of lubricating viscosity having the above-described kinematic viscosity may also be blended with another oil of lubricating viscosity (i.e., an oil of lubricating viscosity other than that defined above). The other oil of lubricating viscosity may be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content ≤0.03 wt %, and ≥90 wt % saturates, viscosity index 80-120); Group III (sulfur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity may comprise an API Group I, Group II (including or other than the oil of lubricating viscosity described above), Group III, Group IV, Group V oil or mixtures thereof.

Natural oils useful in making the disclosed lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included are alkylene oxide polymers and interpolymers and derivatives thereof, in which the terminal hydroxyl groups may have been modified by esterification or etherification. Also included are esters of dicarboxylic acids with a variety of alcohols, or esters made from C5 to C12 monocarboxylic acids and polyols or polyol ethers. Other synthetic oils include silicon-based oils, liquid esters of phosphorus-containing acids, and polymeric tetrahydrofurans.

Unrefined, refined, and rerefined oils, either natural or synthetic, can be used in the lubricants of the present invention. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation. The oil can also be an oil derived from hydroisomerization of wax such as slack wax or a Fischer-Tropsch synthesized wax.

Other oils are materials commonly known as traction fluids. These include polymers of at least one olefin containing 3 to 5 carbon atoms; hydrocarbon molecules containing non-aromatic cyclic moieties; as fluids comprising naphthenic hydrocarbons having 19 carbon atoms, e.g., comprising two substituted cyclohexane rings linked by a methylene group; hydrogenated dimers of $\alpha$-alkyl styrene; hydrogenated polyolefins and adamantane ethers.

In certain embodiments, the oil of lubricating viscosity may comprise a polyalphaolefin (PAO). Typically, polyalphaolefins are derived from monomers having 4 to 30, or 4 to 20, or 6 to 16 carbon atoms. Examples of useful PAOs include those derived from 1-decene. These PAOs may have a viscosity of 1.5 to 150 $mm^2/s$ (cSt) at 100° C. PAOs are typically hydrogenated materials.

The oils of the present technology can encompass oils of a single viscosity range or a mixture of high viscosity and low viscosity range oils. In one embodiment, the oil exhibits a 100° C. kinematic viscosity of 1 or 2 to 8 or to 10 $mm^2/sec$ (cSt).

The lubricating composition as a whole (including the oil of lubricating viscosity and other components, described below) may have a kinematic viscosity at 100° C. of 3.6 to 4.8 cSt ($mm^2/s$), or 4.0 to 4.6 $mm^2/s$ (cSt), or 4.0 to 4.4 $mm^2/s$ (cSt), or 4.0 to 4.2 $mm^2/s$ (cSt). The lubricating composition may have a Brookfield viscosity at −40 C of at most 6,800 mPa·s (cP). The Brookfield viscosity at −40° C. may be 3,000 to 6,800 mPa·s (cP). Similarly, the lubricating composition may have a kinematic viscosity at 100° C. of 3.6 to less than 4.5 $mm^2/s$ (cSt) and a Brookfield viscosity at −40° C. of 3000 to at most 6,800 mPa·s (cP). The lubricating composition may also have a kinematic viscosity at 100° C. of 4.0 to 4.4 $mm^2/s$ (cSt) and a Brookfield viscosity at −40° C. of 3,000 to 6,800 mPa·s (cP). The overall lubricant composition may also be formulated using oil and other components such that the viscosity at 100° C. is 1 or 1.5 to 10 or 15 or 20 $mm^2/sec$ and the Brookfield viscosity (ASTM-D-2983) at −40° C. is less than 20,000 or 15,000 mPa-s (cP), for instance, less than 10,000 or even 5,000 mPa-s.

The oil of lubricating viscosity in the disclosed technology may be present at 60 wt % to 97.5 wt %, or 70 wt % to 95 wt %, or 80 wt % to 95 wt % of the lubricating composition.

Phosphorus-Containing Compound

The formulations described herein will also contain a phosphite ester composition. The phosphite ester composition may be other than a zinc salt, that is it may be a composition that does not contain zinc, as in a zinc salt, for example. Alternatively, in some embodiments that phosphite ester composition may be zinc containing, or there may be a zinc-containing composition present in addition to the phosphite ester. An example of a zinc-containing composition is a zinc dialkyldithiophosphate. In certain embodiments, however, the lubricant composition may be free of or substantially free of zinc and/or zinc dialkyldithiophosphate. (As used herein, "substantially free" means that the amount of the material in question is less than an amount that will affect the relevant performance of the lubricant in a measurable way.)

The phosphite ester will comprise the reaction product, e.g., condensation product, of a monomeric phosphorous acid or an ester thereof with at least two alkylene diols. By "monomeric" phosphorous acid or ester is meant a phosphorous acid or ester, typically containing one phosphorus atom, which may be reacted with a diol in order to form an oligomeric, polymeric, or other condensed species. The monomeric phosphorous acid or ester thereof may be phosphorous acid itself ($H_3PO_3$), although a monomeric partial ester such as a dialkylphosphite may be used for ease of handling or other reasons. The alkyl group or groups may be relatively low molecular weight groups of 1 to 6 or 1 to 4 carbon atoms, such as methyl, ethyl, propyl, or butyl, such that the alcohol generated upon reaction with the alkylene diols may be easily removed. An exemplary phosphorous acid ester is dimethyl phosphite; others include diethyl phosphite, dipropyl phosphite, and dibutyl phosphite. Sulfur-containing analogues may also be employed (e.g., thiophosphites). Other esters include trialkyl phosphites. Mixtures of di- and trialkyl phosphites may also be useful. In these materials, the alkyl groups may be the same or different each independently typically having 1 to 6 or 1 to 4 carbon atoms as described above.

The phosphorus acid or ester will be reacted or condensed with at least two alkylene diols to form the material of the disclosed technology, which may include a polymeric (or oligomeric) phosphorus ester and optionally monomeric species. The first alkylene diol (i) will be a 1,4- or 1,5- or 1,6-alkylene diol. That is to say, there will be two hydroxy groups in a 1,4 or 1,5 or 1,6 relationship to each other, separated by a chain of 4, 5, or 6 carbon atoms, respectively. The first hydroxy group may be literally on the 1 carbon atom, that is, on the a carbon of the diol, or it may be on a higher numbered carbon atom. For example, the diol may also be a 2,5- or 2,6-, or 2,7-diol or a 3,6- or 3,7- or 3,8-diol, as will be evident to the skilled person. The alkylene diol may be branched (e.g., alkyl-substituted) or unbranched and in one embodiment is unbranched. Unbranched, that is, linear diols ($\alpha,\omega$)-diols) include 1,4-butanediol, 1,5-pentane diol, and 1,6-hexanediol. Branched or substituted diols include 1,4-pentanediol, 2-methyl-1,5-pentanediol, 3-methyl-1,5-pentanediol, 3,3-dimethyl-1,5-pentanediol, 1,5-hexanediol, 2,5-hexanediol, and 2,5-dimethyl-2,5-hexanediol. For purposes of the disclosed technology, a diol having one or more secondary hydroxy groups (such as 2,5-hexanediol) may be referred to as a branched or substituted diol, even though the carbon chain itself may be linear.

The location of the hydroxy groups in the 1,4-, 1,5-, or 1,6-positions (that is, either positions relative to each other or literal positions) may be helpful to promote oligomerization with the phosphorous species rather that formation of cyclic structures (which would be sterically disfavored). In certain embodiments the first alkylene diol may be 1,6-hexanediol.

The first alkylene dihydroxy compound (diol) may, if desired, have additional hydroxy groups, that is, more than two per molecule, or there may be exactly two. In one embodiment, there are exactly two hydroxy groups per molecule. If there are more than two hydroxy groups, care should be taken to assure that there is no excessive cyclization such as might interfere with the polymerization reaction, if there are fewer than 4 atoms separating any of the hydroxy groups. Also, care should be taken to avoid excessive branching or crosslinking in the product, which could lead to undesirable gel formation. Such problems may be avoided by careful control of reaction conditions such as control of the ratio of reagents and the order of their addition, performing the reaction under suitably dilute conditions, and reacting under low acid conditions. These conditions can be determined by the person skilled in the art with only routine experimentation.

The phosphorous acid or ester is also reacted with a second alkylene diol (ii). The second alkylene diol is an alkyl-substituted 1,3-propylene diol with one or more of the alkyl substituents thereof being on one or more of the carbon atoms of the propylene unit, the total number of carbon atoms in the alkyl-substituted 1,3-propylene diol being 5 to 12 or 6 to 12 or 7 to 11 or 8 to 18 or, in certain embodiments, 9. That is, the alkyl-substituted 1,3-propylene diol may be represented by the general formula

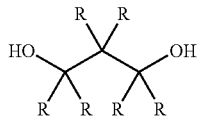

where the various R groups may be the same or different and may be hydrogen or an alkyl group, provided that at least 1 R is an alkyl group and that the total number of carbon atoms in the R groups is 2 to 9 or 3 to 9, so that the total carbon atoms in the diol will be 5 to 12 or 6 to 12, respectively, and likewise for the other ranges of total carbons. By analogy with the above-described, 1,4-, 1,5-, or 1,6-diols, reference here to 1,3-diols means that the two hydroxy groups are in a 1,3 relationship to each other, that is, separated by a chain of 3 carbon atoms. A 1,3-diol may thus also be named as a 2,4- or 3,5-diol. If the 1,3-diol has one or more secondary hydroxy groups, such a molecule will be considered to be a substituted diol. In one embodiment the number of alkyl substituents is 2 and the total number of carbon atoms in the molecule is 9. Suitable substituents may include, for instance, methyl, ethyl, propyl, and butyl (in their various possible isomers).

Examples of the second alkylene diol may include 2,2-dimethyl-1,3-propanediol, 2-ethyl-2-butylpropane-1,3-diol, 2-ethylhexane-1,3-diol, 2,2-dibutylpropane-1,3-diol, 2,2-diisobutylpropane-1,3-diol, 2-methyl-2-propylpropane-1,3-diol, 2-propyl-propane-1,3-diol, 2-butylpropane-1,3-diol, 2-pentylpropane-1,3-diol, 2-methyl-2-propylpropane-1,3-diol, 2,2-diethylpropane-1,3-diol, 2,2,4-trimethylpentane-1,3-diol, 2-methylpentane-2,4-diol, 2,4,-dimethyl-2,4-pentanediol, and 2,4-hexanediol. It should be noted that some of the foregoing nomenclature emphasizes the propane-1,3-diol structure of the molecules, for clarity. For instance, 2-pentylpropane-1,3-diol might also be named 2-hydroxymethylheptan-1-ol, but the latter nomenclature does not so clearly illustrate the 1,3-nature of the diol.

The relative molar amounts of the first alkylene diol (i) and the second alkylene diol (ii) may be in a ratio of 30:70 to 65:35, or alternatively 35:65 to 60:40 or 40:60 to 50:50 or 40:60 to 45:55. If the ratio is less than about 30:70, the resulting product may not fully exhibit the benefits of the disclosed technology, and if it is greater than about 65:35, its compatibility with other components in a lubricant formulation may be reduced.

The relative molar amounts of the monomeric phosphorous acid or ester thereof (a) and the total molar amounts of the alkylene diols (b) may be in a ratio of 0.9:1.1 to 1.1:0.9, or 0.95:1.05 to 1.05:0.95, or 0.98:1.02 to 1.02:0.98, or about 1:1. Reaction in approximately equimolar ratios will tend to encourage formation of oligomers or polymer formation. An exact 1:1 ratio could theoretically lead to extremely long chain formation and consequently very high molecular weight. In practice, however, this is not typically attained since competing reactions and incompleteness of reaction will provide materials of a lesser degree of polymerization, and a certain fraction of the material will be in the form of cyclic monomer.

The reaction product will typically comprise a mixture of individual species, including some oligomeric or polymeric species as well as cyclic monomeric species. The cyclic monomeric species may comprise 1 phosphorus atom and one alkylene group, derived principally from the 1,3-diol (ii), as the 1,3-diol is capable of either participation in oligomerization or cyclic ester formation. The oligomeric or polymeric species may typically comprise 2 or 3 to 20 phosphorus atoms, or alternatively 5 to 10 phosphorus atoms, linked together by alkylene groups derived from the diols (i) and (ii), and may exhibit a relative preference for incorporation of the 1,4-, 1,5-, or 1,6-diols, which are less readily able to cyclize with the phosphorus to form a cyclic monomeric species.

The product of the disclosed technology may be a mixture of species that may be represented by the structures shown:

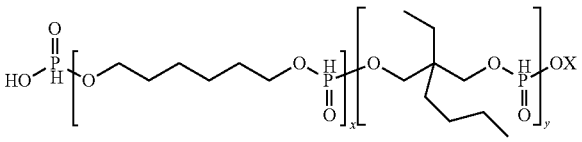

(oligomeric species)

plus

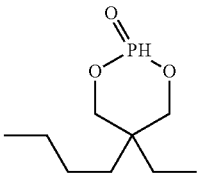

(cyclic monomer species)

where x and y represent the relative amounts of the two diols incorporated into the oligomer. The structure shown is not intended to indicate that the polymer is necessarily a block polymer, since the structures represented by the x and y brackets may be more or less randomly distributed, as influenced by or depending on the availability of the various diol reactants. Each X is independently a terminating group, which may be, for instance, an alkyl group (such as methyl), or hydrogen or a diol-derived moiety which might terminate in an OH group. In the above scheme, for illustrative purposes only, the diene (i) is selected to be 1,6-hexanediol and diene (ii) is selected to be 2-butyl-2-ethyl-1,3-propanediol. Corresponding structures and mixtures would be formed using different diols (i) and (ii).

The relative amounts of oligomeric species and cyclic monomer species in the reaction mixture will depend, to some extent, on the specific diols selected and the reaction conditions. For reaction products prepared from 1,6-hexane diol and 2-butyl-2-ethyl-1,3-propanediol, as in the structures above, the amount of oligomeric product may be approximately as shown in the table below:

| | | | | | |
|---|---|---|---|---|---|
| mol % 1, 6-diol | 30 | 40 | 50 | 60 | 65 |
| wt. % oligomer | 52 | 58 | 62 | 70 | 71 |

and the amount of the cyclic monomer may be 100% minus the percentage of the oligomer. It is also possible that, regardless of the specific diols employed, mixtures having the above weight percentages of oligomer and cyclic monomer may be usefully prepared. In certain embodiments, 55 to 60 weight percent of the product is in oligomeric form and 45 to 40 percent is in cyclic monomer form. In some embodiments the relative amount of the cyclic monomeric species to the amount of the oligomeric species is 1:3 to 1:1 or alternatively 1:3 to 1:0.8 by weight.

The condensation reaction between the phosphorus acid or ester and the diol may be accomplished by mixing the reagents and heating until the reaction is substantially complete. Typically the first and second alkylene diols may be mixed with the phosphorous compound at the same time or nearly the same time, that is, typically before the reaction with one of the alkylene diols is complete. A small amount of a basic material such as sodium methoxide may also be present. If a methyl ester of the phosphorous acid is used as a reagent, substantial completion of the reaction may correspond with the cessation of evolution and distillation of methanol from the reaction mixture. Suitable temperatures include those in the range of 100 to 140° C., such as 110 to 130° C. or 115 to 120° C. If reaction temperatures in excess of about 140° C. are employed, there is a risk that the desired product may not be formed in useful yields or with useful purity, since competing reactions may occur. Reaction times may typically be up to 12 hours, depending on temperature, applied pressure (if any), agitation, and other variables. In some instances reaction times of 2 to 8 hours or 4 to 6 hours may be appropriate.

Other monomers may be included within the reaction mixture if desired. In particular, the inclusion of a polycarboxylic acid, such as a dicarboxylic acid, is sometimes seen as beneficial. For example, inclusion of a relatively minor amount of tartaric acid or citric acid may provide products with useful properties. The amount of polyacid or diacid may an amount suitable to incorporate at least 1, or approximately 1, monomeric unit of poly- or dicarboxylic acid per product oligomer molecule. The amount of polyacid or diacid actually charged to the reaction mixture may be higher than this amount. Without intending to be bound by any theory, it is believed that when a minor amount of tartaric acid is present, it may be incorporated as an end unit of the polymer, possibly being condensed through an ester linkage with an OH group of an alkylene diol. Such materials may exhibit good performance in terms of antiwear protection and corrosion inhibition, as well as seals performance. Suitable polyacids (or their esters or anhydrides) include maleic acid, fumaric acid, tartaric acid, citric acid, phthalic acid, terephthalic acid, malonic acid (e.g., ester), succinic acid, malic acid, adipic acid, oxalic acid, sebacic acid, dodecanedioic acid, glutaric acid, and glutamic acid. Another type of monomer which may be included is a monocarboxylic acid which contains a reactive hydroxy group, or a reactive equivalent of such a material, such as an anhydride, ester, or lactone. Examples include glyoxylic acid, caprolactone, valerolactone, and hydroxystearic acid.

Since there is interest in providing lubricant formulations having low ash (low metal content), in certain embodiments the polymeric phosphorus ester is not a metal-containing material and may be, for instance, not in the form of a zinc salt. In certain applications, for instance, automatic transmission applications, the presence of zinc-containing materials may be detrimental to performance. It is believed that such materials may degrade the performance of wet clutches, possibly by plugging pores of the friction material used therein.

The amount of the phosphorous ester product described above used in lubricants may be an amount sufficient to provide 0.01 to 0.3 or to 0.1 weight percent phosphorus to the composition or, in other embodiments, 0.02 to 0.07 weight percent or 0.025 to 0.05 weight percent. The actual amount of the product which corresponds to these amounts of phosphorus will, of course, depend upon its phosphorus content. Suitable amounts of the ester product in the lubricant composition may be 0.05 or 0.06 to 2.0 weight percent, or 0.1 to 1, or 0.05 to 0.5, or 0.1 to 0.3, or 0.15 to 0.23, or 0.15 to 0.5, or 0.2 to 0.3 weight percent.

In certain embodiments, the lubricant compositions of the present invention are Newtonian fluids or substantially Newtonian fluids. That is to say, their viscosity will be relatively independent of applied shear or, alternatively, their rate of flow will be approximately proportional to the applied shear, apart from the deviations from Newtonian behavior that may be imparted by the presence of a viscosity modifier, which is permitted as described below. In other words, in certain embodiments, the present lubricant compositions are not greases, not materials which flow and lubricate under shear but remain stationary and solid-like in the absence of shear. Conditions of grease manufacture are known to those skilled in the art and generally involve treatment or thickening of a base oil with a thickener, also referred to as a gelling agent or soap. Gelling agents include fatty acid (e.g., C12-20) soaps of metals such as Li, Ca, Na, Al, and Ba, as well as surface coated, finely divided clay particles. It is believed that in greases, oil is maintained within a fibrous structure formed by the gelling agent.

The lubricant compositions described herein may contain other components and additives which are conventionally used in lubricants of the desired end use, such as typically transmission lubricants. Such additives are described in greater detail in U.S. Patent Application Publication US-2006-0172899.

Dispersant

Another material frequently used is a dispersant. Succinimide dispersants, a species of carboxylic dispersants, are prepared by the reaction of a hydrocarbyl-substituted succinic anhydride or reactive equivalent thereof with an amine such as a poly(ethyleneamine). The hydrocarbyl substituent group generally contains an average of at least 8, or 20, or 30, or 35 up to 350, or to 200, or to 100 carbon atoms. In one embodiment, the hydrocarbyl group is derived from a polyalkene such as polyisobutene which may have an $\overline{M}_n$ (number average molecular weight) of at least 500, e.g., 500, or 700, or 800, or 900 up to 5000, or to 2500, or to 2000, or to 1500. In one embodiment the polydispersity ($\overline{M}_w/\overline{M}_n$) is at least 1.5. The substituted succinic acylating agent can be reacted with an amine, including those amines described above and heavy amine products known as amine still bottoms. The amount of amine reacted with the acylating agent is typically an amount to provide a mole ratio of CO:N of 1:2 to 1:0.75. If the reaction is, rather, with an alcohol, the resulting dispersant will be an ester dispersant. If both amine and alcohol functionality are present, whether in separate molecules or in the same molecule (as in the above-described condensed amines), mixtures of amide, ester, and possibly imide functionality can be present. These are the so-called ester-amide dispersants.

The amine employed in preparing a succinimide dispersant may be an aromatic amine, an aromatic polyamine, or mixtures thereof. The aromatic amine may be 4-aminodiphenylamine (ADPA) (also known as N-phenylphenylenediamine), derivatives of ADPA (described in US 2011/0306528 and 2010/0298185), a nitro aniline, an aminocarbazole, an amino-indazolinone, an aminopyrimidine, 4-(4-nitrophenylazo)aniline, or combinations thereof. In one embodiment, the dispersant is derived from an aromatic amine wherein the aromatic amine has at least three non-continuous aromatic rings. The succinimide dispersant may also be a derivative of a polyether amine or polyether polyamine. Typical polyether amine compounds contain at least one ether unit and will be chain terminated with at least one amine moiety. The polyether polyamines can be based on polymers derived from C2-C6 epoxides such as ethylene oxide, propylene oxide, and butylene oxide. Examples of polyether polyamines are sold under the Jeffamine® brand and are commercially available from Hunstman Corporation of Houston, Tex.

"Amine dispersants" are reaction products of relatively high molecular weight aliphatic or alicyclic halides and amines, such as polyalkylene polyamines. "Mannich dispersants" are the reaction products of alkyl phenols in which the alkyl group contains at least 30 carbon atoms with aldehydes (especially formaldehyde) and amines (especially polyalkylene polyamines). "Ester dispersants" are similar to the above-described succinimide dispersants except that they may be seen as having been prepared by reaction of a hydrocarbyl acylating agent and a polyhydric aliphatic alcohol such as glycerol, pentaerythritol, or sorbitol, as described in U.S. Pat. No. 3,381,022. Aromatic succinate esters may also be prepared; see US 2010/0286414.

Post-treated dispersants may also be used. They are generally obtained by reacting a carboxylic (e.g., succinimide), amine or Mannich dispersant with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, 2,5-dimercaptothiadiazole (DMTD), or an aromatic diacid having acid groups in 1,3 or 1,4 positions on a benzene ring (such as terepthahlic acid). Mixtures of dispersants can also be used. In one embodiment a dispersant is present, which is a borated dispersant that is further functionalized with a sulfur or phosphorus moiety. In one embodiment the borated dispersant may be a borated polyisobutylene succinimide dispersant, in which the polyisobutylene portion thereof may have a number average molecular weight of 750 to 2200, or 750 to 1350, or 750 to 1150.

In one embodiment, both a borated dispersant and a non-borated dispersant may be present. The non-borated dispersant may be a hydrocarbyl-substituted succinimide, such as a polyisobutylene succinimide wherein the polyisobutylene portion thereof has a number average molecular weight of about 750 to about 2200, or about 750 to about 1350, or about 750 to about 1150.

The borated and non-borated dispersants may be obtained or obtainable from reaction of succinic anhydride by an "ene" or "thermal" reaction, by what is referred to as a "direct alkylation process." The "ene" reaction mechanism and general reaction conditions are summarized in "Maleic Anhydride," pages, 147-149, B. C. Trivedi and B. C. Culbertson, Plenum Press, 1982. The non-borated dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The borated and non-borated dispersants may also be obtained or obtainable from a chlorine-assisted process, often involving Diels-Alder chemistry, leading to formation of carbocyclic linkages. The process is known to a person skilled in the art. The chlorine-assisted process may produce a non-borated dispersant that is a polyisobutylene succinimide having a carbocyclic ring present on 50 mole % or more, or 60 to 100 mole % (typically 100 mole %) of the dispersant molecules. Both the thermal and chlorine-assisted processes are described in greater detail in U.S. Pat. No. 7,615,521, columns 4-5 and preparative examples A and B.

Dispersants may be prepared from a polyolefin as the hydrocarbyl group, and the polyolefin may be, in certain embodiments, high vinylidene polyisobutylene, that is, having greater than 50, 70, or 75% terminal vinylidene groups ($\alpha$ and $\beta$ isomers). In certain embodiments, the succinimide dispersant may be prepared by the direct alkylation route. In other embodiments it may comprise a mixture of direct alkylation and chlorine-route dispersants. In certain embodiments the dispersant component may be a mixture of multiple dispersants which may be of different types; optionally at least one may be a succinimide dispersant.

The non-borated dispersant may have a nitrogen to carbonyl to ratio (N:CO ratio) of 1:5 to 10:1, 1:2 to 10:1, or 1:1 to 10:1, or 1:1 to 5:1, or 1:1 to 2:1. In one embodiment the non-borated dispersant may have a N:CO ratio of 1:1 to 10:1, or 1:1 to 5:1, or 1:1 to 2:1. The borated dispersant(s) of the present invention may be prepared in such a way to have a N:CO ratio of 0.9:1 to 1.6:1, or 0.95:1 to 1.5:1, or 1:1 to 1.4:1.

The amount of dispersant or dispersants in the compositions, may be, for instance, 0.3 to 10 percent by weight. In other embodiments, the amount is 0.5 to 7 percent or 1 to 5 percent of the final blended fluid formulation. In a concentrate, the amounts will be proportionately higher.

Detergent

The compositions may also include a detergent, that is, a metal salt of an organic acid containing an oleophilic moiety. The organic acid portion of the detergent is typically a sulfonate, carboxylate, phenate, or salicylate. The metal portion of the detergent is typically an alkali or alkaline earth metal. Suitable metals include sodium, calcium, potassium, and magnesium. Typically, the detergents are overbased, meaning that there is a stoichiometric excess of metal over that needed to form the neutral metal salt. Suitable overbased organic salts include organic sulfonate salts having a substantially oleophilic character. Organic sulfonates are well known materials in the lubricant and detergent arts. The sulfonate compound may contain on average 10 to 40 carbon atoms, or 12 to 36 or 14 to 32 carbon atoms on average. Similarly, the phenates, salicylates, and carboxylates have a substantially oleophilic character.

The detergent may be "overbased." By overbasing, it is meant that a stoichiometric excess of the metal be present over that required to neutralize the acid and form a neutral salt. The excess metal from overbasing has the effect of neutralizing acids which may build up in the lubricant. A second advantage is that the overbased salt may increase the dynamic coefficient of friction. Typically, the excess metal will be present over that which is required to neutralize the acid in the ratio of up to 30:1, preferably 5:1 to 18:1 on an equivalent basis.

The amount of the overbased salt utilized in the composition may be typically 0.01 to 10 weight percent or 0.025 to 3 weight percent on an oil free basis, e.g., 0.1 to 6, or 0.2 to 5, or 0.5 to 4, or 1 to 3, or 0.1 to 1.0 percent. The overbased salt is usually made up in about 50% oil with a TBN range of 10-1000, or 10-600 or 200 or greater, or 200 to 600, or 250-1000, on an oil free basis. Borated and non-borated overbased detergents are described in U.S. Pat. Nos. 5,403,501 and 4,792,410. A more detailed description of the expressions "metal ratio," TBN and "soap content" are known to a person skilled in the art and explained in standard textbook entitled "Chemistry and Technology of Lubricants", Third Edition, Edited by R. M. Mortier and S. T. Orszulik, 2010, pages 219 to 220, under the sub-heading 7.2.5, Detergent Classification. TBN may be measured according to ASTM D4739.

In certain embodiments the detergent may comprise a calcium-containing detergent. In certain embodiments, the calcium-containing detergent may be a calcium sulfonate or a calcium phenate detergent, and in some embodiments, a calcium sulfonate detergent.

Overbased sulfonate detergents may have a TBN of 250 to 600, or 300 to 500. In one embodiment the sulfonate detergent may be a predominantly linear alkylbenzene sulfonate detergent having a metal ratio of at least 8 as is described in paragraphs [0026] to [0037] of U.S. Pat. No. 7,407,919. Linear alkyl benzenes may have the benzene ring attached anywhere on the linear chain, usually at the 2, 3, or 4 position, or mixtures thereof. The predominantly linear alkylbenzene sulfonate detergent may provide benefits in fuel economy. In one embodiment the sulfonate detergent may be a metal salt of one or more oil-soluble alkyl toluene sulfonate compounds as disclosed in paragraphs [0046] to [0053] of US 2008/0119378.

In one embodiment, a sulfonate detergent may be a branched alkylbenzene sulfonate detergent. Branched alkylbenzene sulfonate may be prepared from isomerized alpha olefins, oligomers of low molecular weight olefins, or combinations thereof. Suitable oligomers include tetramers, pentamers, and hexamers of propylene and/or butylene. In other embodiments, an alkylbenzene sulfonate detergent may be derived from a toluene alkylate, i.e., the alkylbenzene sulfonate may have at least two alkyl groups, at least one of which is a methyl group, the other being a linear or branched alkyl group as described above.

In one embodiment the lubricating composition may be free of an overbased phenate, and in a different embodiment the lubricating composition may be free of a non-overbased phenate. In another embodiment the lubricating composition may be free of a phenate detergent. In other embodiments, a phenate detergent may be present.

Phenate detergents are typically derived from p-hydrocarbyl phenols or, generally, alkylpheols. Alkylphenols of this type may be coupled with sulfur and overbased, coupled with aldehyde and overbased, or carboxylated to form salicylate detergents. Suitable alkylphenols or alkylsalicylates include those alkylated with oligomers of propylene, i.e. tetrapropenylphenol (i.e. p-dodecylphenol or PDDP) and pentapropenylphenol. Suitable alkylphenols or alkylsalicylates also include those alkylated with oligomers of butene, especially tetramers and pentamers of n-butenes. Other suitable alkylphenols or alkylsalicylate include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent or salicylate detergent derived from PDDP. In one embodiment, the lubricant composition comprises a phenate detergent or salicylate detergent that is not derived from PDDP. In one embodiment, the lubricating composition comprises a phenate detergent or salicylate detergent prepared from PDDP, such detergent contains less than 1.0 weight percent unreacted PDDP, or less than 0.5 weight percent unreacted PDDP, or is substantially free of PDDP.

The metal-containing detergent may be present in an amount to deliver 130 ppm to 600 ppm, or 160 ppm to 400 ppm, or in other embodiments 300 to 10,000 ppm, of metal, and in some embodiments, such amounts of calcium, to the lubricant formulation. The overall amount of the detergent may be as described above.

Phosphorus-Containing Compound

The compositions of the present invention may also include at least one phosphorus-containing compound, other than the reaction product of the phosphorous compound and diols described above. Such phosphorus-containing compound may include phosphorus acid, phosphorus acid salt, phosphorus acid ester or derivative thereof including sulfur-containing analogs in the amount of 0.002-1.0 weight percent. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof. In one embodiment, the phosphorus acid, ester or derivative can be an organic or inorganic phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. One group of phosphorus compounds are alkylphosphoric acid mono alkyl primary amine salts. Compounds of this type are described in U.S. Pat. No. 5,354,484. Eighty-five percent phosphoric acid is a suitable material for addition to the fully-formulated compositions and can be included, if desired, at a level of 0.01 to 0.3 weight percent based on the weight of the composition, such as 0.03 to 0.2 or to 0.1 percent.

Viscosity Modifier

One component frequently used is a viscosity modifier. Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, co-polymers and graft copolymers. Some commercially available VMs and DVMs include polyisobutylenes, olefin copolymers, hydrogenated styrene-diene copolymers, styrene/maleate copolymers, polymethacrylates, some of which have dispersant properties, olefin-graft-polymethacrylate polymers, and hydrogenated polyisoprene star polymers. The VMs and/or DVMs may be incorporated into the fully-formulated compositions at a level of up to 15% by weight, e.g., 1 to 12% or 3 to 10%.

In one embodiment, a lubricating composition as described herein may contain 0.1 wt % to 5 wt % (or 0.5 wt % to 4 wt %) of a linear polymer having dispersant functionality. The linear polymer may have a weight average molecular weight of 5,000 to 25,000, or 8000 to 20,000. (All weight average molecular weights are by GPC using polystyrene standards with weight average molecular weights ranging from 350 to 2,000,000. In one embodiment the linear polymer may include a poly(meth)acrylate or mixtures thereof. The linear polymer may be present in the compositions at 0.1 wt % to 5 wt %, or 0.1 wt % to 4 wt %, or 0.2 wt % to 3 wt %, or 0.5 wt % to 3 wt %, 0.5 wt % to 4 wt % of the lubricating composition.

The linear polymer may have, in certain embodiments, a composition that comprises a poly(meth)acrylate polymer derived from a monomer composition comprising: (a) 50 wt % to 95 wt %, or 60 wt % to 80 wt % of an alkyl (meth)acrylate, wherein the alkyl group of the (meth)acrylate has 10 to 15 carbon atoms; (b) 1 wt % to 40 wt %, or 4 wt % to 35 wt % of an alkyl (meth)acrylate, wherein the alkyl group of the (meth)acrylate has 1 to 9 carbon atoms; (c) 1 wt % to 10 wt %, or 1 wt % to 8 wt % of a dispersant monomer, (d) 0 wt % to 4 wt %, or 0 wt % to 2 wt %, or 0 wt % of a vinyl aromatic monomer (typically styrene); and (e) 0 wt % to 9 wt %, or 0 wt % to 6 wt % of an alkyl (meth)acrylate, wherein the alkyl group of the (meth)acrylate has 16 to 18 carbon atoms. In one embodiment the linear polymer may contain 0 wt % to 20 wt % of 16 to 18 alkyl (meth)acrylate.

Dispersant monomer(s) which may be present are often a nitrogen-containing monomer. The nitrogen-containing monomer may include a vinyl-substituted nitrogen heterocyclic monomer, a dialkylaminoalkyl (meth)acrylate monomer, a dialkylaminoalkyl (meth)acrylamide monomer, a tertiary-(meth)acrylamide monomer, ureido (meth)acrylate. Some examples include N,N-dimethylacrylamide, N-vinyl carbonamides such as N-vinyl-formamide, vinyl pyridine, N-vinylaceto amide, N-vinyl-n-propionamides, N-vinyl hydroxyacetoamide, N-vinyl imidazole, N-vinyl pyrrolidinone, N-vinyl caprolactam, dimethylaminoethyl acrylate (DMAEA), dimethylaminoethyl(meth)acrylate (DMAEMA), dimethyl aminobutylacrylamide, dimethylamino-propyl(meth)acrylate (DMAPMA), dimethylamine-propyl acrylamide, dimethylaminopropyl methacrylamide, dimethylaminoethyl acrylamide, or mixtures thereof. A dispersant monomer may also be oxygen-containing compound. The oxygen-containing compound may include hydroxyalkyl (meth)acrylates such as 3-hydroxypropyl (meth)acrylate, 3,4-dihydroxybutyl (meth)acrylate, 2-hydroxyethyl (meth)acrylate, 2-hydroxypropyl (meth)acrylate, 2,5-dimethyl-1,6-hexanediol (meth)acrylate, 1,10-decanediol (meth)acrylate, carbonyl-containing (meth)acrylates such as 2-carboxyethyl (meth)acrylate, carboxymethyl (meth)acrylate, oxazolidinylethyl (meth)acrylate, N-(methacryloyloxy)formamide, acetonyl (meth)acrylate, N-methacryloylmorpholine, N-methacryloyl-2-pyrrolidinone, N-(2-methacryloyloxyethyl)-2-pyrrolidinone, N-(3-methacryloyloxypropyl)-2-pyrrolidinone, N-(2-methacryloyloxypentadecyl)-2-pyrrolidinone, N-(3-methacryloyloxyheptadecyl)-2-pyrrolidinone; glycol di(meth)acrylates such as ethylene glycol di(meth)acrylate, 1,4-butanediol (meth)acrylate, 2-butoxyethyl (meth)acrylate, 2-ethoxyethoxymethyl (meth)acrylate, 2-ethoxyethyl (meth)acrylate, or mixtures thereof.

The linear polymer of this type is described in more detail in U.S. Pat. No. 6,124,249, or EP 0 937 769 A1 paragraphs [0019] and [0031] to [0067].

Another viscosity modifying polymer that may be present is a star polymer. In one embodiment the lubricating composition of the invention includes a viscosity modifier comprises a star polymer and linear polymer described herein. The star polymer may be derived from a monomer composition comprising $C_{12-15}$ alkyl (meth)acrylate (about 80 wt %), and about 20 wt % of a mixture of monomers composed of methyl (meth)acrylate, 2-ethylhexyl (meth)acrylate, and ethylene glycol di(meth)acrylate. A detailed description of the star polymer disclosed herein may also be described in WO 2007/127660 (published on Nov. 8, 2007, by Baker et al. and assigned to The Lubrizol Corporation), paragraphs [0021] to [0061]. Baker discloses composition and methods of preparation of a variety of star polymers.

A (meth)acrylic polymer having star architecture may have three or more arms that comprise a poly(meth)acrylate polymer, which may be derived from a monomer composition comprising: (a) 50 wt % to 100 wt % of an alkyl (meth)acrylate, wherein the alkyl group of the (meth)acrylate has 12 to 15 carbon atoms; (b) 0 wt % to 40 wt % of an alkyl (meth)acrylate, wherein the alkyl group of the (meth) acrylate has 1 to 9 carbon atoms; (c) 0 wt % to 10 wt % of a dispersant monomer (as described above), (d) 0 wt % to 5 wt %, or 0 wt % to 2 wt %, or 0 wt % of a vinyl aromatic monomer (typically styrene); and (e) 0 wt % to 20 wt %, or 0 wt % to 10 wt %, or 0 wt % of an alkyl (meth)acrylate, wherein the alkyl group of the (meth)acrylate has 16 to 18 carbon atoms.

The star polymer may have a weight average molecular weight of 100,000 to 1,300,000, or 125,000 to 1,000,000, or 150,000 to 950,000, or 200,000 to 800,000.

As used herein the shear stability index (SSI) of the star polymer may be determined by a 20 hour KRL test (Volkswagen Tapered Bearing Roller Test). The test procedure is set out in both CEC-L-45-99 or equivalent test method DIN 51350-6-KRL/C. The star polymer SSI may be in the range of 0 to 100, or 0 to 80, or 0 to 60, or 0 to 50, 0 to 20, or 0 to 15, or 0 to 10, or 0 to 5. An example of a suitable range for the SSI includes 1 to 5, 10 to 25, or 25 to 65.

The star polymer may be a homopolymer or a copolymer, that is, its arms may be homopolymeric or copolymeric (i.e., containing two or more monomer types). In one embodiment the star polymer may be a copolymer. The star polymer may be a star polymer having a random, tapered, di-block, tri-block or multi-block architecture. Typically the star polymer has random or tapered architecture.

The star polymer may be obtained/obtainable from a controlled radical polymerization technique. Examples of a controlled radical polymerization technique include RAFT, ATRP or nitroxide mediated processes. The star polymer may also be obtained/obtainable from anionic polymerization processes. In one embodiment the star polymer may be obtained/obtainable from RAFT, ATRP or anionic polymerization process. In one embodiment the star polymer may be obtained/obtainable from RAFT or ATRP polymerization process. In one embodiment the star polymer may be obtained/obtainable from a RAFT polymerization process. Methods of preparing polymers using ATRP, RAFT or nitroxide-mediated techniques are disclosed in the example section of International Publication WO 2006/047398, see examples 1 to 47.

The star polymers may be prepared by techniques known in the art to prepare either core-first or arm-first approaches. Typically the star polymer is prepared by an "arm-first" approach using RAFT or ATRP (typically RAFT) polymerization techniques.

Friction Modifier

Another component that may be used in the present composition is a friction modifier. Friction modifiers are well known to those skilled in the art and include such materials as fatty phosphites, fatty acid amides, fatty epoxides, borated fatty epoxides, fatty amines, glycerol esters, borated glycerol esters, alkoxylated fatty amines, borated alkoxylated fatty amines, metal salts of fatty acids, sulfurized olefins, fatty imidazolines, condensation products of carboxylic acids and polyalkylene-polyamines, metal salts of alkyl salicylates, amine salts of alkylphosphoric acids, and mixtures thereof. Representatives of each of these types of friction modifiers are known and are commercially available, and are described in greater detail in the aforementioned US-2006-0172899.

Among the amine friction modifiers described in the above U.S. Application are tertiary amines of the general structure $R^1R^2NR^3$ where $R^3$ can be a polyol-containing alkyl group (that is, a group containing 2 or more hydroxy groups) or a group containing one or more hydroxy groups and one or more amine groups. For instance, $R^3$ may be —$CH_2$—CHOH—$CH_2OH$ or a homologue thereof, containing, for example, 3 to 8 carbon atoms or 3 to 6 carbon atoms or 3 to 4 carbon atoms, and 2, 3, 4 or more hydroxy groups (normally no more than one hydroxy group per carbon atom). A typical resulting product may thus be represented by $$R^1R^2N—CH_2—CHOH—CH_2OH$$

or homologues thereof, where $R^1$ and $R^2$ are independently alkyl groups of 8 to 20 carbon atoms. Such products may be obtained by the reaction of a dialkyl amine with an epoxide or chlorohydroxy compound. For example, reaction of a secondary amine with glycidol (2,3-epoxy-1-propanol) or "chloroglycerine" (that is, 3-chloro-propane-1,2-diol) may be effective. Such materials based on the reaction of dicocoamine with one or more moles of glycidol or chloroglycerine are useful in providing friction-modifying performance. If reaction is with multiple moles of glycidol or chloroglycerine, or other epoxyalkanols or chlorodiols, a dimeric or oligomeric ether-containing group, that is, a hydroxyl-substituted alkoxyalkyl group, may result.

Another friction modifier may be an amide represented by the structure $R^3$—C(═O)—$NR^1R^2$ wherein $R^1$ and $R^2$ are each independently hydrocarbyl groups of at least 6 carbon atoms, such as 6 to 24 carbon atoms, and $R^3$ is a hydroxyalkyl group of 1 to 6 carbon atoms. Such a material may be prepared from the reaction of a carboxylic acid or a reactive equivalent thereof with an amino alcohol. Examples include the reaction product of isostearic acid or an alkyl succinic anhydride with tris-hydroxymethylaminomethane. Such friction modifiers are described in greater detail in U.S. Pat. No. 7,381,691, Adams et al., Jun. 3, 2008.

In certain embodiments the lubricant composition may contain a friction modifier component which comprises (α) an N-substituted oxalic acid bisamide or amide-ester containing at least two hydrocarbyl groups of about 12 to about 22 carbon atoms; or (β) a condensation product of (i) an aromatic polycarboxylic acid or mixtures thereof or a reactive equivalent thereof, having at least two carboxylic groups situated so as to permit formation of a cyclic imide having 5 or 6 atoms in said cyclic structure; with (ii) an aliphatic primary amine or alcohol containing about 6 to about 80 carbon atoms; or both (α) and (β). The presence of one or more of such friction modifiers (α) or (β) may impart good friction performance to a driveline device such as an automatic transmission.

The component described as (α) This component may be, when in the form of the bisamide, may be represented by the formula

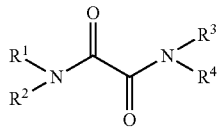

In this structure at least two of the Rs are independently groups comprising a hydrocarbyl group of 1 to 22 carbon atoms and up to two of the R groups are hydrogen or a hydrocarbyl group of 10 or fewer carbon atoms. In other embodiments, one or more of the R groups may independently contain 12 to 20 or 12 to 18 or 12 to 16 or 12 to 14 or 14 to 20 or 14 to 18 or 14 to 16 carbon atoms. If there are two hydrocarbyl groups of 12 to 22 carbon atoms, they may be both on the same nitrogen or they may be on different nitrogen atoms; that is, either $R^3$ and $R^4$ or alternatively $R^1$ and $R^4$ may be hydrogen. The hydrocarbyl groups may be the same or different within a given molecule or within a mixture of molecules in the overall composition.

Since at least two of the groups $R^1$, $R^2$, $R^3$ and $R^4$ in the above structure comprise a hydrocarbyl group of 12 to 22 carbon atoms, such groups may be such a hydrocarbyl group, for instance, an alkyl group of 12 to 22 carbon atoms. Alternatively, such groups may comprise such a hydrocarbyl group as a part of a larger structure. That is, such groups may have the general structure such as $R^5R^6N$—$R^9$— where one or both of the $R^5$ and $R^6$ are hydrocarbyl groups of 12 to 22 carbons and optionally one of the $R^5$ and $R^6$ may be hydrogen or a shorter hydrocarbyl group. $R^9$ would be a hydrocarbylene linking group, such as methylene, ethylene, propylene, or butylene, and in some cases a 1-3-propylene group.

In some embodiments, therefore, the substituted oxalic acid bisamide may comprise a material of the structure about in which two of the groups $R^1$, $R^2$, $R^4$, and $R^4$ are independently alkyl groups of about 12 to about 22 carbon atoms. Such materials may have a structure such as

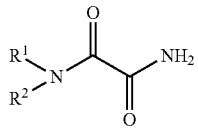

wherein each $R^1$ and $R^2$ is independently an alkyl group of about 12 to about 18 carbon atoms. Such a material may be obtained or obtainable by known methods such as the process of reacting a dialkylamine with an alkyl oxamate such as ethyl oxamate.

In another embodiment, the N-substituted oxalic acid bisamide or amide-ester of (α) comprises an amide-ester represented by the formula:

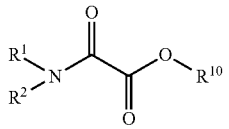

In this embodiment, $R^1$ and $R^2$ may independently be hydrocarbyl groups of 12 to 22 carbon atoms, as defined elsewhere herein, and $R^{10}$ may be a hydrocarbyl group of 1 to 22 carbon atoms. In certain embodiments, $R^{10}$ is methyl, ethyl, n-propyl, isopropyl, n-butyl, sec-butyl, isobutyl, or t-butyl.

In certain embodiments the friction modifier (α) may be represented by the formula

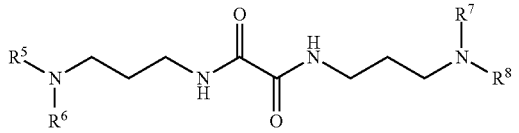

wherein $R^5$ and $R^7$ are independently a hydrocarbyl group of about 12 to about 22 carbon atoms and $R^6$ and $R^8$ are independently hydrogen or a hydrocarbyl group of 10 or fewer carbon atoms or a hydrocarbyl group of about 12 to about 22 carbon atoms. Diamines suitable for preparing such products include those in the "Duomeen" series, available from Akzo, having a general structure such as

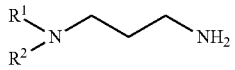

These and other friction modifiers designated herein as (α) are described in greater detail in U.S. Pat. No. 8,691,740, Vickerman et al., Apr. 8, 2014.

With regard to the friction modifier labeled as (β), the aromatic polycarboxylic acid or reactive equivalent thereof may be a diacid, a triacid, a tetraacid, or a higher acid (or reactive equivalents). If the reaction product is a monoimide, the polycarboxylic acid will contain at least two acid (or equivalent) groups. If the reaction product is a diimide, the polycarboxylic acid will contain at least four acid (or equivalent) groups. The acid groups are situated so as to permit (but not require) formation of a 5-membered or 6-membered cyclic imide, which means that they may be, for instance, in positions ortho to each other on an aromatic ring.

Reactive equivalents of carboxylic acids include acids, esters, acid halides such as acid chlorides, and anhydrides. For their ready availability and ease of reaction, anhydrides, especially cyclic anhydrides, are often used. The condensation products of the (β) component may have, but will not necessarily have, a cyclic imide structure: they may comprise, for instance, an ester or an amide group or an imidazoline group.

The carboxylic acid groups may be attached directly to an aromatic group, or they may be indirectly attached through intervening carbon atoms. An example of a material of the latter sort would be an aromatic ring substituted by at least one succinic acid (or anhydride) group, with other ring substituents also optionally present, such as phenylsuccinic acid or anhydride.

In other embodiments the aromatic polycarboxylic acid may comprise an aromatic group with at least two carboxylic groups bonded directly to at least two aromatic carbon atoms. The aromatic groups may be simple (one ring) or condensed rings. The carboxylic acid groups may be on adjacent positions on an aromatic ring (e.g., ortho to each other) or they may be appropriately situated on different aromatic rings. Examples include phthalic anhydride, pyromellitic anhydride, and naphthalene-1,8-dioic anhydride. The former have groups on a benzene ring; the latter has groups on a naphthalene (i.e., condensed) ring. The latter is an example of a material having two carboxylic acid groups located on positions 1 and 8 and capable of forming a cyclic imide with 6 atoms in the ring:

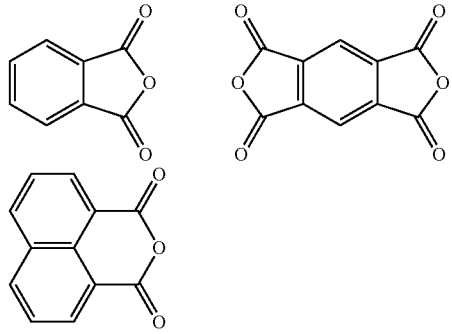

The aromatic polycarboxylic acid will be condensed with a primary amine or alcohol containing 6 to 60 carbon atoms. The type of condensation product obtained will depend on the reactants. If the reactant is an alcohol, the product will be an ester, either a monoester (i.e., partial esters) or a polyester (that is, a diester, triester, or tetraester, depending on the identity of the aromatic polycarboxylic acid. Polymeric products are not intended by the term "polyester," although polymeric materials would not necessarily be precluded). The type of ester would depend the number of equivalents of the alcohol that are reacted. If the reactant is a primary amine, the product may be an amide or an imide, depending, again, on the number of equivalents of amine reacted and the reaction conditions, as will be evident to the person skilled in the art. More severe conditions are typically required to form the cyclic imide. In certain embodiments the condensation product comprises an imide, and in certain cases a diimide. In certain embodiments the condensation product comprises a pyromellitic diimide.

In certain embodiments, the product is a condensation product with an aliphatic primary amine represented by the formula $H_2N—(C_nH_{2n})—X—R^1$, wherein n is 2 to 6, X is O or $N—R^2$, $R^1$ is an alkyl group of at least 8 or at least 10 carbon atoms, and $R^2$ is H or an alkyl group. Groups $R^1$ and $R^2$ may be alkyl groups containing at least 4 carbon atoms, for instance, 6 to 40 or 8 to 30 or 10 to 24 or 12 to 20 or 16 to 18 carbon atoms, and mixtures of such groups. In certain embodiments, the aliphatic primary amine of the above structure comprises an N,N-dialkyl-1,3-propanediamine, which may comprise, for instance, N,N-di-hydrogenatedtallow-1,3-propanediamine, N,N-dicoco-1,3-propanediamine, or N,N-diisostearyl-1,3-propanediamine.

Diamines suitable for preparing such products include those in the Duomeen™ series, available from AkzoNobel, having a general structure such as

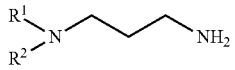

In certain embodiments the friction modifier (β) may be represented by the formula

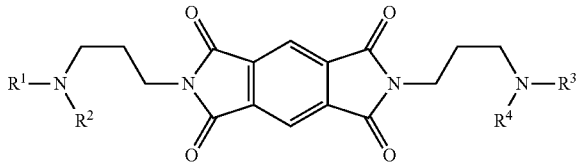

wherein each of $R^1$ and $R^3$ is independently an alkyl group of about 8 to about 22 carbon atoms and each of $R^2$ and $R^4$ is independently hydrogen or an alkyl group of 1 to about 22 carbon atoms, provided that the total number of carbon atoms in $R^1$ and $R^2$ is at least about 13 and the total number of carbon atoms in $R^3$ and $R^4$ is at least about 13. These and other friction modifiers designated herein as (β) are described in greater detail in U.S. Publication US 2014/0107001, Saccomando et al., Apr. 17, 2014.

In the structures shown above for the friction modifiers (α) and (β), the groups $R^1$ through $R^8$, if they are hydrocarbyl groups, may be linear or branched hydrocarbyl groups, and they may optionally contain some sites of unsaturation or some cyclic structures, as may be present in the R group or groups of the amine from which they are prepared. In some embodiments the cyclic structures may comprise 5 membered or 6 membered carboxylic rings.

In certain embodiments the friction modifier component, in addition to (α) and/or (β), may further comprise (γ) a tertiary amine represented by the formula $$R^1R^2NR^3$$

wherein $R^1$ and $R^2$ are each independently an alkyl group of at least 6 carbon atoms and $R^3$ is a polyhydroxyl-containing alkyl group or a polyhydroxyl-containing alkoxyalkyl group, as described above.

The amount of the friction modifier, whether as an individual component or as a mixture of individual friction modifiers, may be 0.1 to 5 weight percent, or 0.2 to 2 weight percent, or 0.4 to 1.5 weight percent.

Other Materials

Other materials can optionally be included in the compositions, provided that they are not incompatible with the aforementioned required components or specifications. One class of such materials includes a variety of compounds that may exhibit a variety of performance benefits including friction modification (especially, friction reduction), anti-wear performance, or other benefits. Such materials are the compounds are generally obtained or obtainable by a process comprising reacting a hydroxy acid with at least one member selected from the group consisting of an amine, an alcohol, and an aminoalcohol. The product may comprise an ester, an amide, or an imide. Examples include oleyl tartrimide (the imide formed from oleylamine and tartaric acid) and oleyl diesters (from, e.g., mixed C12-16 alcohols). Other related materials that may be useful include esters, amides, and imides of other hydroxy-carboxylic acids in general, including hydroxy-polycarboxylic acids, for instance, acids such as tartaric acid, citric acid, lactic acid, malic acid, glycolic acid, hydroxy-propionic acid, hydroxyglutaric acid, and mixtures thereof. These materials are described in greater detail in US Publication 2006-0079413 and PCT publication WO2010/077630. Such derivatives of (or compounds derived from) a hydroxy-carboxylic acid, if present, may typically be present in the lubricating composition in an amount of 0.1 weight % to 5 weight %, or 0.2 weight % to 3 weight %, or greater than 0.2 weight % to 3 weight %.

Another optional material may be an ester of a polyacid, e.g., of a diacid, such as a dialkyl adipate, e.g., di-tridecyl adipate. Such an ester may provide performance as a solubilizer or a seal swell agent. If present, its amount may be 0.01 to 2 percent by weight, or 0.05 to 1.5, or 0.1 to 1.0, or 0.3 to 0.8 weight percent.

Other optional materials include antioxidants, that is, oxidation inhibitors), including hindered phenolic antioxidants, secondary aromatic amine antioxidants such as dinonyldiphenylamine as well as such well-known variants as mononyldiphenylamine and diphenylamines with other alkyl substituents such as mono- or di-octyl, sulfurized phenolic antioxidants, oil-soluble copper compounds, phosphorus-containing antioxidants, and organic sulfides, disulfides, and polysulfides such as 2-hydroxyalkyl,alkyl thioethers or 1-t-dodecylthio-2-propanol or sulfurized 4-carbobutoxycyclohexene or other sulfurized olefins. In one embodiment, the antioxidant may be an amine antioxidant which may be a phenyl-α-naphthylamine (PANA) or a hydrocarbyl substituted diphenylamine, or mixtures thereof. The hydrocarbyl substituted diphenylamine may include mono- or di-$C_4$ to $C_{16}$-, or $C_6$ to $C_{12}$-, or $C_9$-alkyl diphenylamine. For example the hydrocarbyl substituted diphenylamine may be octyl diphenylamine, or di-octyl diphenylamine, dinonyl diphenylamine, typically dinonyl diphenylamine. In one embodiment the antioxidant may be a hindered phenol antioxidant. Such materials often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenolor 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba, or butyl 3-(3,5-di-tert-butyl-4-hydroxyphenyl)propanoate.

When present, the antioxidant may be present at 0.1 wt % to 1.2 wt %, or 0.2 to 1 wt %, or 0.3 wt % to 1.0 wt %, or 0.4 wt % to 0.9 wt %, or 0.5 wt % to 0.8 wt %, of the lubricating composition.

Other optional components include seal swell compositions, such as isodecyl sulfolane or phthalate esters, which are designed to keep seals pliable. Also permissible are pour point depressants, such as alkylnaphthalenes, polymethacrylates, vinyl acetate/fumarate or/maleate copolymers, and styrene/maleate copolymers. Another material is an anti-wear agent such as zinc dialkyldithiophosphates. Another optional material may be a $C_8$ to $C_{20}$ alkyl amine salt of a mono- or di-alkyl phosphate or thiophosphate ester, which may be present in an amount to provide 100 to 2000 parts per million by weight of phosphorus to the lubricant composition. These optional materials are known to those skilled in the art, are generally commercially available, and are described in greater detail in published European Patent Application 761,805. Another material which may be present is a borate ester such as a trialkyl borate, which may be useful to as an extreme pressure/anti-wear agent. The alkyl groups thereof may contain 4 to 12 carbon atoms, or 6 to 10 carbon atoms, or 8 carbon atoms. In one embodiment the trialkyl borate comprises tri(2-ethylhexyl) borate. The amount of the alkyl borate, if present, may be 0.1 to 1 weight percent or 0.2 to 0.7 weight percent or 0.3 to 0.4 weight percent. Also included can be known materials such as corrosion inhibitors (e.g., tolyltriazole, dimercaptothiadiazoles), dyes, fluidizing agents, odor masking agents, and antifoam agents. Organic borate esters and organic borate salts can also be included.

Other components that may be present include various sulfur-containing materials such as dimercaptothiadiazoles and derivatives thereof that may serve as corrosion inhibitor, metal deactivator, or rust inhibitor. One specific material is 2,5-dimercapto-1,3,4-thiadiazole (DMTD); derivatives thereof are often used. Derivatives of DMTD include: (a) 2-hydrocarbyldithio-5-mercapto-1,3,4-thiadiazole or 2,5-bis-(hydrocarbyldithio)-1,3,4-thiadiazole and mixtures thereof, such as 1,3,4-thiadiazole, 2,5-bis(tert-nonyldithio); (b) carboxylic esters of DMTD; (c) condensation products of alpha-halogenated aliphatic monocarboxylic acids with DMTD; (d) reaction products of unsaturated cyclic hydrocarbons and unsaturated ketones with DMTD; (e) reaction products of an aldehyde and a diaryl amine with DMTD; (f) amine salts of DMTD; (g) dithiocarbamate derivatives of DMTD; (h) reaction products of an aldehyde, and an alcohol or aromatic hydroxy compound, and DMTD; (i) reaction products of an aldehyde, a mercaptan and DMTD; (j) 2-hydrocarbylthio-5-mercapto-1,3,4-thiadiazole; and (k) products from combining an oil soluble dispersant with DMTD; and mixtures thereof. Compositions a)-k) are described in U.S. Pat. No. 4,612,129. Suitable amounts of DMTD may include 0.01 to 15 weight percent, 0.02 to 10, 0.05 to 5, and 0.1 to 3 weight percent.

The above components can be in the form of a fully-formulated lubricant or in the form of a concentrate within a smaller amount of lubricating oil. If they are present in a concentrate, their concentrations will generally be directly proportional to their concentrations in the more dilute form in the final blend.

In certain embodiments the lubricating composition may have a composition as described in the following table:

| | Embodiments (wt %) | | |
|---|---|---|---|
| Additive | A | B | C |
| Disclosed Phosphite | 0.01 to 2 | 0.1 to 1.2 | 0.2 to 0.8 |
| Ashless Dispersant | 0.05 to 10 | 0.75 to 6 | 1.5 to 5 |
| Antioxidant | 0.05 to 1 | 0.2 to 3 | 0.5 to 2 |
| Dispersant | 0 or 0.05 to 5 | 0 or 0.05 to 4 | 0.05 to 2 |
| Viscosity Modifier | | | |
| Overbased Detergent | 0 or 0.05 to 15 | 0.1 to 6 | 0.5 to 3 |
| Antiwear Agent | 0 or 0.05 to 15 | 0.1 to 10 | 0.3 to 5 |
| Friction Modifier | 0 or 0.05 to 6 | 0.05 to 4 | 0.1 to 2 |
| Viscosity Modifier | 0 or 0.05 to 10 | 0.5 to 8 | 1 to 6 |
| Any Other Performance Additive | 0 or 0.05 to 10 | 0 or 0.05 to 8 | 0 or 0.05 to 6 |
| Oil of Lubricating Viscosity | Balance to 100% | Balance to 100% | Balance to 100% |

In certain embodiments, such as for engine lubricants, it is sometimes desirable to provide lubricants with relatively restricted amounts of sulfated ash (ASTM D874), phosphorus, and/or sulfur. Thus, for certain embodiments the sulfated ash may be less than 1.5%, such as 0.1 to 1.5% or 0.2 to 1.5%, or values of up to 1.2 or 1.0 or 0.6%. Similarly, the amount of phosphorus in the lubricant (from all sources) may be less than 0.12 weight percent, such as 0.01 to 0.12 percent or 0.03 to 0.12 percent, or up to 0.01 or 0.08 or 0.06 or 0.03 percent by weight. Like-wise the amount of sulfur in the lubricant (from all sources) may be less than 0.4 weight percent, such as 0.01 to 4 weight percent or up to 0.35 or 0.3 weight percent. Any one of these values or limitations may be present independently, or all may be present together.

The above-described lubricant composition may be used for lubricating a mechanical device, by supplying thereto the lubricant. The mechanical devices which may benefit from the present lubricant are not particularly limited but may include internal combustion engines (including gasoline or diesel fueled or mixed fuel engine or hybrid engines), gears, hydraulic systems, and transmissions, including automatic transmissions, manual transmissions, and variants thereof such as dual clutch transmissions and continuously variable transmissions, including push-belt transmissions and traction drives.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the pre-dominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain atoms other than carbon in a ring or chain otherwise composed of carbon atoms. Heteroatoms include sulfur, oxygen, nitrogen, and encompass substituents as pyridyl, furyl, thienyl and imidazolyl. In general, no more than two, or no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Products are prepared by reacting 1 mole of dimethylphosphite with 1 mole (total) (that is, relative molar amounts, i.e., mole ratio) of mixtures of diols as set forth in the table below. The following is an example of a specific synthesis: To a 3-L four-necked round bottom flask equipped with a nitrogen subsurface inlet tube, thermocouple, mechanical glass rod stirrer, and a Dean-Stark trap connected to a sequence of a Friedrichs cold water condenser and a isopropanol-dry ice cold finger, is added dimethyl hydrogen phosphite (660.3 g, 6 mol), 1,6-hexanediol (283.6 g, 2.4 mol) and 2-butyl-2-ethyl-1,3-propanediol (673.1 g, 3.6 mol). Sodium methoxide (anhydrous) (1.3 g, 0.024 mol, 0.4 mol %) is then added in one portion with stirring under nitrogen. The reaction is heated to 115° C. and held at this temperature for 2 hours. After that, it is held at 120° C. for an additional 6 hours, during which time methanol is removed by distillation. After cooling the reaction vessel to 90° C., the reaction is subjected to vacuum stripping under reduced pressure (1-7 Pa (1-5 mmHg)), removing additional methanol and other volatiles. The final product is a clear, slightly viscous liquid.

The materials are evaluated by gel permeation chromatography and the weight percent of the oligomeric species is reported. The weight percent of cyclic monomeric species is 100% minus the amount of the oligomeric species.

| Example | diol (i), mole % | diol (ii), mole % | weight percent oligomeric species. |
|---|---|---|---|
| 1* | 1,6-hexanediol, 0 | 2-butyl-2-ethyl-1,3-propanediol, 100 | 25 |
| 2 | 1,6-hexanediol, 30 | 2-butyl-2-ethyl-1,3-propanediol, 70 | 52 |
| 3 | 1,6-hexanediol, 40 | 2-butyl-2-ethyl-1,3-propanediol, 60 | 59 |
| 4 | 1,6-hexanediol, 45 | 2-butyl-2-ethyl-1,3-propanediol, 55 | 62 |
| 5 | 1,6-hexanediol, 50 | 2-butyl-2-ethyl-1,3-propanediol, 50 | 63 |
| 6 | 1,6-hexanediol, 55 | 2-butyl-2-ethyl-1,3-propanediol, 45 | 67 |
| 7 | 1,6-hexanediol, 60 | 2-butyl-2-ethyl-1,3-propanediol, 40 | 71 |
| 8 | 1,6-hexanediol, 65 | 2-butyl-2-ethyl-1,3-propanediol, 35 | 71 |
| 9* | 1,6-hexanediol, 75 | 2-butyl-2-ethyl-1,3-propanediol, 25 | 80 |
| 10* | 1,6-hexanediol, 100 | 2-butyl-2-ethyl-1,3-propanediol, 0 | 100 |
| 11 | 1,6-hexanediol, 40 | 2-methyl-2-propyl-1,3-propanediol, 60 | — |
| 12 | 1,4-butanediol, 45 | 2-methyl-2-propyl-1,3-propanediol, 55 | — |
| 13 | 1,4-butanediol, 40 | 2-ethyl-1,3-hexanediol, 60 | — |
| 14 | 1,4-butanediol, 50 | 2-propyl-1,3-propanediol, 50 | — |
| 15 | 1,5-pentanediol, 37 | 2-butyl-2-ethyl-1,3-propanediol, 63 | — |
| 16 | 1,5-pentanediol, 40 | 2-ethyl-1,3-hexanediol, 60 | — |
| 17 | 1,5-pentanediol, 40 | 2-propyl-1,3-propanediol, 60 | — |

*A comparative or reference example.
— not determined
" the above chemical

Certain of the above products are formulated into a lubricant characteristic of a continuously variable transmission (CVT) fluid. The lubricant contains the following components (weight percents): Dispersants (borated and/or treated with a dimercaptothiadiazole, 3.1%); Overbased calcium detergents (0.41%); Borate ester friction modifier (0.12%); Alkyl borate (0.35%); Ethoxylated amine friction modifier (0.03%); Friction stabilizer (0.08%); Alkyl acetamide (1%); Long chain hydroxy-alkylamine (0.08%); Ester synthetic fluid (0.4%); Antioxidant (0.8%); Substituted triazole (0.02%); Substituted thiadiazole (0.1%); Seal swell agent (0.5%); Pour point depressant (0.1%); Viscosity index modifiers (7.92%); commercial antifoam agents (0.1%); Mineral base oil (balance to=100%). The above products (from certain of the above synthetic examples) are added at 0.26% by weight to the CVT formulation. In a comparative example, a conventional phosphite, dibutylphosphite (dibutyl hydrogen phosphite, "DBP") is added, also at 0.26% by weight.

The fully formulated lubricants are subjected to a 3-element variable speed friction tester (VSFT) test. In this test, three belt elements from a CVT belt are located against a metal surface, lubricated with the test fluid, to simulate the contact interface of an actual CVT belt and pulley. After a short break-in period, several cycles are run under a load of 306.5 kg with the speed varying between 300 rpm and 0 rpm, at a temperature of 100° C. The static coefficient of friction is the maximum value obtained during each cycle. The test results are shown in the table below:

| | | Static Coefficient of Friction | |
|---|---|---|---|
| Example | Material | Run 1 | Run 2 |
| 18* | DBP | 0.127 | 0.127 |
| 19* | Ex 1 (0% HDO) | 0.131 | 0.128 |
| 20 | Ex 2 (30% HDO) | 0.131 | 0.128 |
| 21 | Ex 3 (40% HDO) | 0.131 | 0.130 |
| 22 | Ex 4 (45% HDO) | 0.131 | 0.132 |
| 23 | Ex 5 (50% HDO) | 0.130 | 0.131 |
| 24 | Ex 6 (55% HDO) | 0.130 | 0.129 |
| 25 | Ex 7 (60% HDO) | 0.128 | 0.131 |

*A reference or comparative example
HDO = hexanediol

The formulations tested exhibit improved (increased) static coefficient of friction in this test, compared with the conventional phosphorus additive dibutylphosphite.

Certain of the above products are formulated into a lubricant characteristic of an automatic transmission fluid. The transmission fluid contains 3.37 percent by weight of borated succinimide dispersants, 1.42 percent by weight of friction modifiers, 0.22 percent by weight of metal-containing detergents, 0.08 percent by weight of antiwear agent(s), 0.11 percent by weight of friction stabilizer, 1.68 percent by weight polymeric viscosity modifier(s), and 2.99 percent by weight of a combination of one or more seal swell agents, antioxidants, antifoam agents, pour point depressants, and corrosion inhibitor. The formulation is prepared in mineral oil. The above products, from the examples, are added at 0.2 percent by weight, as shown in the table below. In a comparative example, a conventional phosphite, dibutylphosphite (dibutyl hydrogen phosphite, "DBP") is added, also at 0.26% by weight. The fully formulated lubricants are subjected to the Mercon V Four-Ball test, according to ASTM D4172 and the Mercon Falex EP test according to ASTM D3233. The test results are shown in the table below:

| Example | Material | MerconV Four-Ball (wear scar diameter, mm) 100° C. | 150° C. |
|---|---|---|---|
| 26* | DBP | 0.55 | 0.53 |
| 27* | Ex 1 (0% HDO) | 0.49 | 0.48 |
| 28 | Ex 2 (30% HDO) | 0.46 | 0.49 |
| 29 | Ex 3 (40% HDO) | 0.41 | 0.46 |
| 30 | Ex 4 (45% HDO) | 0.45 | 0.49 |
| 31 | Ex 5 (50% HDO) | 0.46 | 0.51 |
| 32 | Ex 6 (55% HDO) | 0.42 | 0.42 |
| 33 | Ex 7 (60% HDO) | 0.42 | 0.43 |
| 34 | Ex. 8 (65% HDO) | 0.42 | 0.46 |

The results of the Mercon V Four-Ball wear test, above, show improved (reduced) wear compared to the conventional phosphorus additive dibutylphosphite. The results of the Mercon Falex EP test show results for materials of Ex. 2 through Ex 7 comparable to that of dibutylphosphite, in the Table below:

| Example | Material | MerconV Falex EP (failure load, kg (lb.)) 100° C. | 150° C. |
|---|---|---|---|
| 35* | DBP | 680 (1500) | 410 (900) |
| 36* | Ex 1 (0% HDO) | 790 (1750) | 270 (600) |
| 37 | Ex 2 (30% HDO) | 500 (1100) | 270 (600) |
| 38 | Ex 3 (40% HDO) | 680 (1500) | 340 (750) |
| 39 | Ex 4 (45% HDO) | 640 (1400) | 230 (500) |
| 40 | Ex 5 (50% HDO) | 860 (1900) | 450 (1000) |
| 41 | Ex 6 (55% HDO) | 570 (1250) | 340 (750) |

-continued

| Example | Material | MerconV Falex EP (failure load, kg (lb.)) 100° C. | 150° C. |
|---|---|---|---|
| 42 | Ex 7 (60% HDO) | 680 (1500) | 340 (750) |
| 43 | Ex. 8 (65% HDO) | 730 (1600) | 410 (900) |

The formulations of the disclosed technology may also exhibit less or no objectionable odor.

A lubricant formulation, characteristic of a dual-clutch transmission fluid, is prepared for testing, including the following components: Nitrogen-containing dispersant(s) (3%), Corrosion inhibitor (0.5%); Overbased calcium sulfonate detergent (0.12%); Friction modifiers (0.49%); Friction stabilizer (0.1%); Antioxidant (0.6%); Seal swell agent (0.35%); Antifoam agent(s) (0.02%); Viscosity modifier (10.9%); Mineral base oil (balance to=100%). To this formulation is added an amount of a material of the disclosed technology.

A lubricant formulation, characteristic of the core formulation of a manual transmission fluid, is prepared for testing, including the following components: Substituted thiadiazole corrosion inhibitor (0.2%); Dispersant(s) (borated and/or treated with a dimercaptothiadiazole, 1.125%); Aminic antioxidant (0.5%); Overbased calcium detergent (0.145%); Polyalphaolefin (8%); Materials of the disclosed technology (0.306 or 0.356%); Mineral base oil (balance to=100%).

Lubricant formulations, characteristic of engine oil lubricants, are also prepared for testing, with the formulations as shown in the table below:

| | Example: 71[1] | 72[1] | 73[1] | 74[1] | 75 | 76 | 77 | 78 |
|---|---|---|---|---|---|---|---|---|
| Group II base oil | Balance to 100% | | | | | | | |
| Material of Ex. 3 | | | | | 0.4 | | 0.4 | 0.4 |
| Material of Ex. 6 | | | | | | 0.45 | | |
| Dibutyl phosphite | 0.13 | 0.13 | 0.13 | 0.13 | | | | |
| Di($C_{16-18}$ alkyl) phosphite | 0.95 | 0.95 | 0.95 | 0.95 | | | | |
| Di(2-ethylhexyl) tartrate | 0.3 | 0.3 | | | 0.3 | 0.3 | | |
| $C_{8-10}$ alkyl malate | | | 0.3 | | | | 0.3 | |
| Triethyl citrate | | | | 0.3 | | | | 0.3 |
| 600 TBN Overbased Ca sulfonate[2] | 0.86 | | 0.86 | 0.86 | 0.86 | 0.86 | 0.86 | 0.86 |
| 650 TBN Overbased Mg sulfonate | | 0.85 | | | | | | |
| 15 TBN succinimide dispersant[3] | 2 | 2 | 2 | 2 | 2 | 2 | 2 | 2 |
| Ashless Antioxidant[4] | 1.5 | 1.5 | 1.5 | 1.5 | 1.5 | 1.5 | 1.5 | 1.5 |
| Other Additives[5] | 0.75 | 0.75 | 0.75 | 0.75 | 0.75 | 0.75 | 0.75 | 0.75 |
| % Ca[6] | 0.20 | | 0.20 | 0.20 | 0.20 | 0.20 | 0.20 | 0.20 |
| % mg[6] | | 0.12 | | | | | | |
| % P[6] | 0.070 | 0.070 | 0.070 | 0.070 | 0.070 | 0.070 | 0.070 | 0.070 |
| % Sulfated Ash[6] | 0.6 | 0.6 | 0.6 | 0.6 | 0.6 | 0.6 | 0.6 | 0.6 |
| TBN[6] | 7.2 | 7.2 | 7.2 | 7.2 | 7.2 | 7.2 | 7.2 | 7.2 |

[1]Reference or comparative examples

[2]Blend of 520 TBN and 690 TBN materials

[3]Polyisobutene-substituted succinimide dispersant (polymer Mn ~2200)

[4]Ashless antioxidant includes a mixture of hindered phenol, alkylated diarylamine, and sulfurized olefin

[5]Other additives include viscosity index improver, pour point depressant, foam inhibitor, and supplemental friction modifier

[6]Calculated values

A series of 5W-20 lubricating compositions is prepared according to the table above. For the malic acid and citric acid esters, similar formulations are prepared differing only in the replacement of the calcium overbased detergent with an equivalent magnesium overbased detergent. The lubricating compositions are evaluated for wear resistance and friction reduction in a high frequency reciprocating rig (HFRR). In addition, the lubricating examples are evaluated for oxidative stability by Pressure Differential Scanning calorimetry (PDSC) and deposit control, as measured in the Komatsu Hot Tube test (KHT) and MHT TEOST.

The lubricants are evaluated for wear performance in a programmed temperature high frequency reciprocating rig (HFRR) available from PCS Instruments. HFRR conditions for the evaluations are 200 g load, 75 minute duration, 1000 micrometer stroke, 20 hertz frequency, and temperature profile of 15 minutes at 40° C. followed by an increase in temperature to 160° C. at a rate of 2° C. per minute. Wear scar in micrometers and film formation as percent film thickness are then measured with lower wear scar values and higher film formation values indicating improved wear performance.

The percent film thickness is based on the measurement of electrical potential between an upper and a lower metal test plate in the HFRR. When the film thickness is 100%, there is a high electrical potential for the full length of the 1000 micrometer stroke, suggesting no metal to metal contact. Conversely for a film thickness of 0% there is no electrical potential suggesting continual metal to metal contact between the plates. For intermediate film thicknesses, there is an electrical potential suggesting the upper and lower metal test plate have a degree of metal to metal contact as well as other areas with no metal to metal contact.

Deposit control is measured by the Komatsu Hot Tube (KHT) test, which employs heated glass tubes through which sample lubricant is pumped, approximately 5 mL total sample, typically at 0.31 mL/hour for an extended period of time, such as 16 hours, with an air flow of 10 mL/minute. The glass tube is rated at the end of test for deposits on a scale of 0 (very heavy varnish) to 10 (no varnish).

Oxidation control is evaluated utilizing pressure differential scanning calorimtery (PDSC) which determines oxidation induction time (OIT) for lubricating compositions. This is a standard test procedure in the lubricating oil industry, based on CEC L-85 T-99. In this testing the lubricating composition is heated to an elevated temperature, typically about 25° C. below the average decomposition temperature for the sample being tested (in this case 215° C. at 690 kPa), and the time to when the composition begins to decompose is measured. The longer the test time, reported in minutes, the better the oxidative stability of the composition and the additives present within it.

Deposits are also evaluated utilizing the industry standard MHT TEOST test (ASTM D7097).

A lubricant suitable for a continuously variable transmission is provided, which contains oil, viscosity modifiers, corrosion inhibitor, seal swell agent, borate ester friction modifiers, nitrogen-containing friction modifiers, dispersants, overbased detergents, phosphoric acid, and antifoam agents. It also contains 0.30 weight percent dibutyl phosphite and 0.12 weight percent di (longer chain hydrocarbyl) phosphite. The lubricant is modified by replacing the dibutyl phosphite and the longer chain phosphite with the material prepared according to Example 3 (with 40 mole % hexanediol and 60 mole % 2-butyl-2-ethyl-1,3-propanediol).

| material, weight percent | Reference 80 | Ex. 81 | Ex. 82 |
|---|---|---|---|
| Dibutyl phosphite | 0.30 | — | — |
| Di (longer chain hydrocarbyl) phosphite | 0.12 | — | — |
| Material of Ex. 3 | — | 0.26 | 0.15 |

The lubricants of Reference example 80 and Examples 81 and 82 are subjected to wear testing and static friction testing and exhibit equivalent good results, even at lower phosphorus content.

The lubricants are also subjected to the ISOT (Indiana Stirred Oxidation Test) to evaluate their foaming performance after ageing by this test for 96 hours and after 168 hours. Foaming of the aged samples is evaluated by ASTM D892-13. The numbers reported in the table below are the amount of foam (in mL). Sequence I results is the foam volume subjected to the 24° C. portion of the test; Sequence II is the foam volume from a second portion of the sample subjected to the 93.5° C. portion of the test. Sequence III is the volume of foam generated by the same sample portion, any remaining foam being collapsed and the temperature cooled below 43.5° C., then testing at 24° C. It is desired that the amount of foam after each sequence is less than 50 mL. The results are shown in the table below:

| | Ref. 80 | Ex. 81 | Ex. 82 |
|---|---|---|---|
| Foam after ISOT, 96 hr, 150° C. | | | |
| Sequence I | 330 | 120 | 0 |
| Sequence II | 30 | 60 | 0 |
| Sequence III | 320 | 470 | 0 |
| Foam after ISOT, 168 hr., 150° C. | | | |
| Sequence I | 170 | 340 | 0 |
| Sequence II | 30 | 50 | 20 |
| Sequence III | 280 | 470 | 0 |

In certain formulations the foaming performance of the lubricant is improved, while retaining the good wear performance (e.g., at less than 0.25 or 0.20 percent by weight of the disclosed ester composition).

Examples 83 Through 87

Lubricant formulations are prepared with the components as shown in the table below:

| Example: | 83 | 84 | 85 | 86 | 87 |
|---|---|---|---|---|---|
| Material prepared as in Example 5 | — | 0.20 | — | 0.20 | 0.10 |
| Dibutyl phosphite | 0.23 | — | 0.23 | — | 0.10 |
| Product of pyromellitic dianhydride and Duomeen ™ 2IS[a] | 1.00 | 1.00 | 0.90 | 0.90 | 0.80 |
| 85% phosphoric acid | 0.064 | 0.064 | 0.064 | 0.064 | 0.064 |
| Alkyl borate | 0.10 | 0.10 | 0.10 | 0.10 | 0.10 |
| Alkenyl imidazoline | 0.008 | 0.008 | 0.008 | 0.008 | 0.008 |
| Ethoxylated amine | 0.035 | 0.035 | 0.035 | 0.035 | 0.035 |
| Long chain hydroxyalkyl amine | 0.50 | 0.50 | 0.50 | 0.50 | 0.50 |
| Alkenyl phosphite | 0.12 | 0.12 | 0.12 | 0.12 | 0.12 |
| Borate ester | 0.15 | 0.15 | 0.15 | 0.15 | 0.15 |
| Antioxidants | 1.2 | 1.2 | 1.2 | 1.2 | 1.2 |
| Detergent package | 0.28 | 0.28 | 0.28 | 0.28 | 0.28 |
| Viscosity modifier package | 0.79 | 0.79 | 0.79 | 0.79 | 0.79 |
| Corrosion inhibitors | 0.22 | 0.22 | 0.22 | 0.22 | 0.22 |
| Antifoam agents | 0.10 | 0.10 | 0.10 | 0.10 | 0.10 |
| Seal swell agent | 0.4 | 0.4 | 0.4 | 0.4 | 0.4 |
| Carboxylic ester solubilizer | 0.5 | 0.5 | 0.5 | 0.5 | 0.5 |
| Other minor components | 0.04 | 0.04 | 0.04 | 0.04 | 0.04 |
| Additional diluent oil | 4.4 | 4.4 | 4.4 | 4.4 | 4.4 |

[a]Duomeen 2IS is believed to have two R groups with an isostearyl structure.

The materials of Examples 83 through 87 are tested using by evaluating the coefficient of friction of an engaging clutch material as the relative rate of rotation between the two engaging surfaces decreases to near zero. The test is run at 40, 80, and 120° C. The samples exhibit increased coefficient of friction with velocity at all temperatures; the results at 40° C. are characteristic and are shown in the table below:

| Example: | 83 | 84 | 85 | 86 | 87 |
|---|---|---|---|---|---|
| Friction coefficient at 1 rpm | 0.128 | 0.132 | 0.132 | 0.134 | 0.135 |
| 2 rpm | 0.133 | 0.137 | 0.138 | 0.139 | 0.140 |
| 5 rpm | 0.141 | 0.144 | 0.145 | 0.147 | 0.146 |
| 10 rpm | 0.145 | 0.149 | 0.150 | 0.151 | 0.150 |

Examples 88 Through 90

Three formulations are prepared, each containing detergents, dispersants, and other conventional additives as follows:

| | |
|---|---|
| Dispersants (borated succinimide dispersant, succinimide dispersant treated with borating agent and dimercaptothiadiazole, and partial ester/amine detergent, treated with borating agent and dimercaptothiadiazole) | 3.28% |
| Calcium benzenesulfonate detergents, overbased and neutral, linear and branched alkyl groups | 0.28% |
| Antioxidant(s), anti-wear agent(s) friction modifier(s), corrosion inhibitor(s), seal swell agent(s), solubilizers(s), antifoam agent(s) and other relatively minor conventional components | 3.04% |
| Dispersant viscosity modifier, a nitrogen-containing polymethacrylate | 0.64% |
| "Star" or "radial" architecture polymethacrylate viscosity modifier | 0.25% |
| Mixture of 3 and 4 $mm^2/s$ (at 100° C.) gas-to-liquid base oils and diluent oils accompanying other components | Balance to = 100% |

The three specific formulation contain the additional additives as shown:

| | Ex. 88 | Ex. 89 | Ex. 90 |
|---|---|---|---|
| Material prepared as in Example 5 | 0.2 | 0.2 | 0.2 |
| Product of pyromellitic dianhydride and Duomeen ™ 2IS | 1 | 1 | 1 |
| Tertiary amine with long-chain alkyl groups and a polyhydroxyl-containing alkyl group | 0 | 0.25 | 0.5 |
| API Group III oil | 1.01 | 1.06 | 1.06 |
| Diluent oils | 3.06 | 3.01 | 3.01 |

The formulations of Examples 88, 89, and 90 are subjected to the same friction testing reported for Examples 83-87, above. The results of the 40° C. testing at 12 hours are shown below, reporting coefficient of friction at various rotational speeds:

| | Amount of tertiary amine | 1 rpm | 2 rpm | 5 rpm | 10 rpm |
|---|---|---|---|---|---|
| Ex. 88 | 0 | 0.143 | 0.146 | 0.151 | 0.154 |
| Ex. 89 | 0.25 | 0.139 | 0.141 | 0.149 | 0.153 |
| Ex. 90 | 0.5 | 0.132 | 0.137 | 0.144 | 0.149 |

In the same test, the initial anti-shudder durability/frictional stability is evaluated by observing the slope of the μ-V curve (coefficient of friction as a function of velocity) at 0.3 m/s and noting its change over the duration of an 18 hour test.

| | Amount of tertiary amine | 0 hours | 6 hours | 12 hours | 18 hours |
|---|---|---|---|---|---|
| Ex. 88 | 0 | 0.61 | 13.47 | 17.67 | 17.54 |
| Ex. 89 | 0.25 | 6.26 | 16.05 | 20.62 | 24.47 |
| Ex. 90 | 0.5 | 11.10 | 22.66 | 26.35 | 29.29 |

The results in the first table show that all the friction coefficient levels are approximately the same and relatively high, as a function of rpm, while increasing slightly at greater relative speed. The high coefficient of friction is indicative of good torque capacity. The results in the second table show that that slope of the μ-V curve increases with time, a more positive slope being desirable for anti-shudder stability. These properties are enhanced by the presence of the polyhydroxy-containing amine.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising an oil of lubricating viscosity and a phosphite ester composition (A), other than a zinc salt, which comprises the reaction product of (a) a monomeric phosphorous acid or an ester thereof with (b) at least two alkylene diols:

a first alkylene diol (i) having two hydroxy groups in a 1,4 or 1,5 or 1,6 relationship;

a second alkylene diol (ii) being an alkyl-substituted 1,3-propylene diol with one or more of the alkyl substituents thereof being on one or more of the carbon atoms of the propylene unit, the total number of carbon atoms in the alkyl-substituted 1,3-propylene diol being about 5 to about 12;

wherein the relative molar amounts of monomeric phosphorous acid or ester thereof (a) and the total of the alkylene diols (b) are in a ratio of about 0.9:1.1 to about 1.1:0.9; and wherein the relative molar amounts of the first alkylene diol (i) and the alkyl-substituted 1,3-propylene diol (ii) are in a ratio of about 30:70 to about 65:35.

2. The lubricant composition of claim 1 wherein the amount of the phosphite ester composition is about 0.05 or 0.06 to about 2.0 weight percent of the lubricant composition.

3. The lubricant composition of claim 1 wherein monomeric phosphorous ester comprises dimethyl phosphite.

4. The lubricant composition of claim 1 wherein the first alkylene diol comprises 1,4-butanediol, 1,5-pentanediol, or 1,6-hexanediol.

5. The lubricant composition of claim 1 wherein the second alkylene diol comprises 2-ethyl-2-butylpropane-1,3-diol, 2-ethylhexane-1,3-diol, 2,2-dibutylpropane-1,3-diol, or 2-methyl-2-propylpropane-1,3-diol.

6. The lubricant composition of claim 1 wherein the phosphite ester composition comprises at least one oligomeric species comprising 2 or 3 to about 20 phosphorus atoms and at least one cyclic monomeric species comprising a single phosphorus atom.

7. The lubricant composition of claim 1 comprising a cyclic monomeric species comprising a single phosphorus atom and a chain of 3 carbon atoms derived from the second alkylene diol.

8. The lubricant composition of claim 6 wherein the relative amount of the cyclic monomeric species to the amount of the oligomeric species is about 1:3 to about 1:1 by weight.

9. The lubricant composition of claim 1 wherein the amount of the phosphite ester composition is an amount to provide about 0.01 to about 0.3 weight percent phosphorus to the composition.

10. The lubricant composition of claim 1 further comprising at least one dispersant, viscosity modifier, antioxidant, or corrosion inhibitor.

11. The lubricant composition of claim 1 further comprising a substituted thiadiazole corrosion inhibitor.

12. The lubricant composition of claim 1 wherein:

the oil of lubricating viscosity has a kinematic viscosity at 100° C. of about 2.8 to about 5 or to about 3.6 $mm^2/s$ (cSt) and a viscosity index of about 104 to about 130 or about 110 to less than about 120 and wherein the lubricant composition further comprises:

(B) about 1.2 to about 5.0 wt % of at least one borated dispersant, wherein at least one borated dispersant is further functionalized with a sulfur or phosphorus moiety;

(C) a calcium-containing detergent, wherein the detergent is present in an amount to deliver at least about 110 ppm to about 700 ppm of calcium to the lubricant composition;

(D) at least one phosphorus-containing compound in addition to the phosphite ester composition (A) and (E) about 0.1 wt % to about 5 wt % of a polymeric viscosity modifier having dispersant functionality, wherein the viscosity modifier has a weight average molecular weight of about 5,000 to about 25,000.

13. The lubricant composition of claim 12 wherein the additional phosphorus-containing compound (D) comprises phosphoric acid.

14. The composition of claim 12, wherein the borated dispersant (B) is a borated polyisobutylene succinimide dispersant, wherein the polyisobutylene of the borated polyisobutylene succinimide has a number average molecular weight of about 750 to about 2200.

15. The lubricant composition of claim 1 further comprising a non-borated dispersant.

16. The lubricant composition of claim 15, wherein the non-borated dispersant is a polyisobutylene succinimide wherein the polyisobutylene portion thereof has a number average molecular weight of about 750 to about 2200.

17. The lubricant composition of claim 12, wherein the borated dispersant has a N:CO ratio of about 0.9:1 to about 1.6:1.

18. The lubricant composition of claim 1 wherein the composition further comprises a C8-20 hydrocarbyl phosphite, or a C12-18 hydrocarbyl phosphite, or C16-18 hydrocarbyl phosphite.

19. The lubricant composition of claim 12, wherein the calcium-containing detergent (C) is a calcium sulfonate or calcium phenate.

20. The lubricant composition of claim 1 further comprising:

(G) about 0.2 to about 3 percent by weight of an amide represented by the structure $R^3—C(=O)—NR^1R^2$ wherein $R^1$ and $R^2$ are each independently hydrocarbyl groups of at least 6 carbon atoms, such as 6 to 24 carbon atoms, and $R^3$ is a hydroxyalkyl group of 1 to 6 carbon atoms;

(H) about 0.03 to about 0.5 percent by weight of a tertiary amine represented by the structure $R^4R^5NR^6$ where $R^4$ and $R^5$ are each independently hydrocarbyl groups of at least 6 carbon atoms, such as 6 to 24 carbon atoms, and $R^6$ is an alkyl group substituted by at least two hydroxy groups;

(I) about 2 to about 5 percent by weight of a nitrogen-containing dispersant reacted with (i) dimercaptothiadiazole, (ii) a borating agent, and (iii) an inorganic phosphorus compound, and optionally (iv) an aromatic diacid having acid groups in 1,3 or 1,4 positions on a benzene ring;

(J) about 0.2 to about 2 weight percent of a dialkyl phosphite wherein the two alkyl groups independently contain 3 to 6 carbon atoms, such as dibutyl phosphite; and (K) about 0.1 to about 1 weight percent of a trialkyl borate, wherein each alkyl group independently contains 4 to about 12 carbon atoms.

21. The lubricant composition of claim 1 further comprising:

(N) about 0.1 to about 4 percent by weight of a metal-containing overbased detergent having a TBN of at least 200 (calculated on an oil-free basis), wherein the metal-containing overbased detergent contributes about 0.03 to about 1.0% by weight of calcium to the lubricant composition;

(O) about 0.05 to about 3 percent by weight of a dihydrocarbyl phosphite or a trihydrocarbyl phosphite wherein the hydrocarbyl groups each independently contain 2 to 8 carbon atoms;

(P) a phosphorus-containing material comprising a zinc dialkyldithiophosphate or C8 to C20 alkylamine salt of a mono- or di-alkyl phosphate or thiophosphate ester, in an amount to provide about 100 to about 2000 parts per million by weight of phosphorus to the lubricant composition;

(Q) about 0.1 to about 0.3 percent by weight of 2,5-dimercapto-1,3,4-thiadiazole or a hydrocarbyl-substituted 2,5-dimercapto-1,3,4-thiadiazole; and (R) about 0.1 to about 5 percent by weight of a nitrogen-containing dispersant.

22. The lubricant composition of claim 1 further comprising:

(W) about 1 to about 3 percent by weight of an alkylsuccinimide dispersant, (X) about 0.2 to about 0.7 percent by weight of a corrosion inhibitor;

(Y) about 0.25 to about 0.65 percent by weight of one or more friction modifiers; and (Z) about 0.05 to about 0.4 percent by weight of a detergent.

23. The lubricant composition of claim 1 further comprising:

(a) about 0.2 to about 2 percent by weight of one or more phosphorus-based antiwear agents;

(b) about 0.1 to about 1 percent by weight of a borated dispersant;

(c) about 0.5 to about 5 percent by weight of a dispersant other than a borated dispersant;

(d) about 0.03 to about 0.3 percent by weight of a borate ester friction modifier;

(e) about 0.1 to about 1.0 percent by weight of an overbased metal detergent;

(f) about 0.03 to about 0.3 percent by weight of one or more corrosion inhibitors; and (g) about 0.5 to about 3 percent by weight total of one or more additional additives of pour point depressants, antioxidants, antifoam agents, esters, or friction stabilizers.

24. The lubricant composition of claim 1 further comprising:

about 0.75 to about 6 percent by weight of an ashless dispersant;

about 0.2 to about 3 percent by weight of an antioxidant;

0 to about 4 percent by weight of a dispersant viscosity modifier;

about 0.1 to about 6 percent by weight of an overbased detergent about 0.1 to about 10 percent by weight of an antiwear agent;

about 0.05 to about 4 percent by weight of a friction modifier;

and up to about 8 percent by weight of any other performance additive.

25. The lubricant of claim 24 wherein the amount of the phosphite ester composition (A) is about 0.1 to about 1.2 percent by weight.

26. The composition of claim 1, further comprising a friction modifier component which comprises:

(a) an N-substituted oxalic acid bisamide or amide-ester containing at least two hydrocarbyl groups of about 12 to about 22 carbon atoms; or (b) a condensation product of (i) an aromatic polycarboxylic acid or mixtures thereof or a reactive equivalent thereof, having at least two carboxylic groups situated so as to permit formation of a cyclic imide having 5 or 6 atoms in said cyclic structure; with (ii) an aliphatic primary amine or alcohol containing about 6 to about 80 carbon atoms; or both (a) and (b).

27. The composition of claim 26 wherein the friction modifier comprises (a) which is represented by the formula

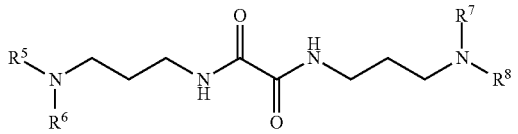

wherein $R^5$ and $R^7$ are independently a hydrocarbyl group of about 12 to about 22 carbon atoms and $R^6$ and $R^8$ are independently hydrogen or a hydrocarbyl group of 10 or fewer carbon atoms or a hydrocarbyl group of about 12 to about 22 carbon atoms.

28. The composition of claim 26 wherein the friction modifier comprises (b) which is represented by the formula

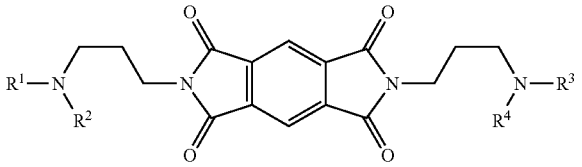

wherein each of $R^1$ and $R^3$ is independently an alkyl group of about 8 to about 22 carbon atoms and each of $R^2$ and $R^4$ is independently hydrogen or an alkyl group of 1 to about 22 carbon atoms, provided that the total number of carbon atoms in $R^1$ and $R^2$ is at least about 13 and the total number of carbon atoms in $R^3$ and $R^4$ is at least about 13.

29. The composition of claim 26 wherein the friction modifier component further comprises (g) a tertiary amine represented by the formula $$R^1R^2NR^3$$

wherein $R^1$ and $R^2$ are each independently an alkyl group of at least 6 carbon atoms and $R^3$ is a polyhydroxyl-containing alkyl group or a polyhydroxyl-containing alkoxyalkyl group.

30. The composition of claim 26 wherein the amount of the friction modifier component is about 0.2 to about 2 weight percent.

31. A method for lubricating a mechanical device, comprising supplying thereto the lubricant composition of claim 1.

32. The method of claim 31 wherein said mechanical device is a drivetrain component.

33. The method of claim 32 wherein said drivetrain component is a transmission.

34. The method of claim 32 wherein said drivetrain component is an automatic transmission.

35. The method of claim 31 wherein said mechanical device comprises a gear.

* * * * *